US012703464B2

(12) United States Patent
Agnihotri et al.

(10) Patent No.: US 12,703,464 B2
(45) Date of Patent: Aug. 11, 2026

(54) METHODS AND APPARATUS FOR RELATIVE GUIDANCE OF WATERCRAFT

(71) Applicant: The Boeing Company, Arlington, VA (US)

(72) Inventors: Abhijeet Agnihotri, Cambridge, MA (US); Max Lewis Greene, Cambridge, MA (US)

(73) Assignee: The Boeing Company, Arlington, VA (US)

( * ) Notice: Subject to any disclaimer, the term of this patent is extended or adjusted under 35 U.S.C. 154(b) by 314 days.

(21) Appl. No.: 18/529,415

(22) Filed: Dec. 5, 2023

(65) Prior Publication Data

US 2025/0178703 A1 Jun. 5, 2025

(51) Int. Cl.
*B63B 49/00* (2006.01)

(52) U.S. Cl.
CPC ..... *B63B 49/00* (2013.01)

(58) Field of Classification Search
CPC ..... B63B 49/00; G05D 1/00; G05D 1/0206
See application file for complete search history.

(56) References Cited

U.S. PATENT DOCUMENTS

2011/0144836 A1* 6/2011 Larkin ..... G05D 1/0692 701/21
2021/0294329 A1* 9/2021 Afman ..... G08G 3/00

FOREIGN PATENT DOCUMENTS

WO WO-2022084073 A1 * 4/2022 ..... G08G 3/02

OTHER PUBLICATIONS

Garmin, "Surround View System," Garmin Ltd, retrieved from https://www.garmin.com/en-us/surroundview/ in 2023, 7 pages.
Liinasuo et al, "Building's digital twin model shown as first-person and third-person views," IOP Conference Series: Earth Environ. Sci. 1101 082018, Jun. 26-30, 2022, 11 pages, Melbourne, Australia.

* cited by examiner

*Primary Examiner* — Luke Huynh
(74) *Attorney, Agent, or Firm* — Hanley, Flight & Zimmerman, LLC

(57) ABSTRACT

Systems, apparatus, articles of manufacture, and methods are disclosed to relatively maneuver watercraft. A disclosed apparatus includes interface circuitry communicatively coupled to a sensor carried by a first watercraft, machine-readable instructions, and programmable circuitry to at least one of instantiate or execute the machine-readable instructions to: calculate a pose between the first watercraft and a second watercraft based on output from the sensor, determine whether the first watercraft is within a threshold offset relative to the second watercraft based on the pose, and provide an indication as to whether or not to adjust operation of the first watercraft based on whether or not the first watercraft is within the threshold offset relative to the second watercraft.

20 Claims, 12 Drawing Sheets

METHODS AND APPARATUS FOR RELATIVE GUIDANCE OF WATERCRAFT

GOVERNMENT INTEREST

This invention was made with Government support under contract No. N6523623C8011 awarded by the Defense Advanced Research Projects Agency (DARPA). The Government has certain rights in this invention.

FIELD OF THE DISCLOSURE

This disclosure relates generally to guidance of watercraft and, more particularly, to methods and apparatus for relative guidance of watercraft.

BACKGROUND

In recent years, watercraft undertaking proximal maneuvering, such as Underway Replenishment (UNREP) carried out by naval ships or autonomous ship operation, utilize standardized maritime navigation interfaces developed by the International Maritime Organization (IMO). These interfaces are known as the Electronic Chart Display and Information Systems (ECDISs) and display navigational information on ships. ECDISs provide real-time vessel position and movement information, as well as chart data, radar data, and other important information required for safe navigation. Additionally, ECDISs provide a map display, a data information panel, and various control panels and menus for accessing and controlling navigation/guidance systems.

SUMMARY

An example apparatus includes interface circuitry communicatively coupled to a sensor carried by a first watercraft, machine-readable instructions, and programmable circuitry to at least one of instantiate or execute the machine-readable instructions to calculate a pose between the first watercraft and a second watercraft based on output from the sensor, determine whether the first watercraft is within a threshold offset relative to the second watercraft based on the pose, and provide an indication as to whether or not to adjust operation of the first watercraft based on whether or not the first watercraft is within the threshold offset relative to the second watercraft.

An example non-transitory computer-readable medium includes instructions to cause processor circuitry to at least calculate a pose between a first watercraft and a second watercraft based on output from a sensor carried by the first watercraft, determine whether the first watercraft is within a threshold offset relative to the second watercraft based on the pose, and provide an indication as to whether or not to adjust operation of the first watercraft based on whether or not the first watercraft is within the threshold offset relative to the second watercraft.

An example method includes calculating a pose between a first watercraft and a second watercraft based on output from a sensor carried by the first watercraft, determining whether the first watercraft is within a threshold offset relative to the second watercraft based on the pose, and providing an indication as to whether or not to adjust operation of the first watercraft based on whether or not the first watercraft is within the threshold offset relative to the second watercraft.

Figure 1:
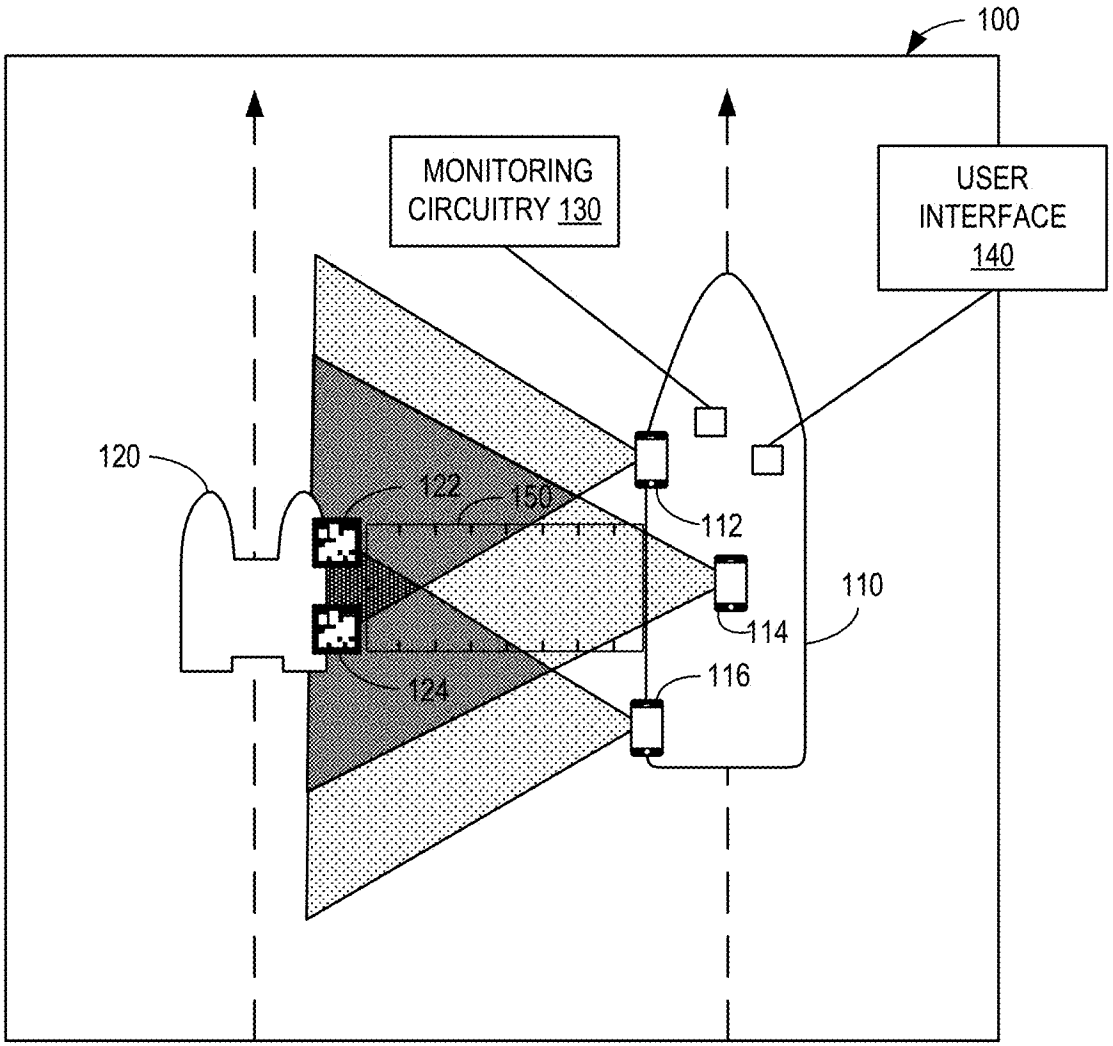
FIG. 1 is a block diagram of an example watercraft guidance system in accordance with teachings of this disclosure.

In general, the same reference numbers will be used throughout the drawing(s) and accompanying written description to refer to the same or like parts. The figures are not necessarily to scale. Instead, the thickness of the layers or regions may be enlarged in the drawings. Although the figures show layers and regions with clean lines and boundaries, some or all of these lines and/or boundaries may be idealized. In reality, the boundaries and/or lines may be unobservable, blended, and/or irregular.

DETAILED DESCRIPTION

FIG. 1 is a block diagram of an example watercraft guidance system 100 in accordance with the teachings of this disclosure. In this example, a first watercraft 110 operates to maneuver with respect to a second watercraft 120. In the illustrated example of FIG. 1, the first watercraft 110 carries example sensors 112, 114, and 116, each of which may be associated with (e.g., part of, a component of, etc.) at least one portable device (e.g., a portable computing device, a mobile computing device, etc.). While three example sensors 112, 114, 116 are depicted in this example, one sensor, two sensors, or more than three sensors may, additionally or alternatively, be utilized. Further, the second watercraft 120 includes example markers 122 and 124 mounted thereon. While two markers 122, 124 are depicted in this example, one marker or more than two markers may, additionally or alternatively, be utilized. In this example, output from the sensors 112, 114, 116 is utilized by monitoring circuitry 130 to display guidance information on a user interface 140. To that end, in some examples, the monitoring circuitry 130 utilizes the output from the sensors 112, 114, 116 so that guidance information can be used to maintain a threshold offset 150 and/or a positional relationship corresponding to the threshold offset 150 between the first watercraft 110 and the second watercraft 120.

To analyze and/or determine a pose between the first watercraft 110 with respect to the second watercraft 120, the watercraft guidance system 100 of the illustrated example determines a relative heading, a relative position, and/or a relative speed of the first watercraft 110 with respect to the second watercraft 120. As used herein, the terms "pose" and "relative pose" refer to a position, an orientation, and a distance of a first coordinate frame with respect to a second coordinate frame. Accordingly, a global coordinate frame can be used to determine the actual/true positions of the first coordinate frame and the second coordinate frame. In this example, the first coordinate frame corresponds to the first watercraft 110 and the second coordinate frame corresponds to the second watercraft 120.

In operation, the example watercraft guidance system 100 determines the aforementioned pose to enable a user/operator of the first watercraft 110 to effectively guide and/or maneuver the first watercraft 110 with respect to the second watercraft 120. In known implementations, ECIDSs primarily display information about a respective ship, but do not convey information about other ships in proximity thereof. Therefore, known ECDIS implementations do not effectively aid maneuvering proximal watercraft. However, as disclosed herein, the example watercraft guidance system 100 provides informative displays representing multiple watercraft in proximity to one another and useful indications for adjustments based on the proximity.

As mentioned above, in some examples, the sensors 112, 114, 116 may be implemented in or as part of portable devices carried by the first watercraft 110, for example. The example sensors 112, 114, 116 may include one or more of a mobile device camera, a positional sensor, a proximity sensor, a range-finding sensor, etc. In one example, the sensors 112, 114, 116 are utilized to determine the position of the second watercraft 120 based on distances of the markers 122, 124.

To display and/or convey information corresponding to the aforementioned pose to the aforementioned user/operator, the first watercraft 110 utilizes the example monitoring circuitry 130 to track and/or determine the position of the second watercraft 120 with respect to the first watercraft 110 and, in turn, display the results to the user/operator of the first watercraft 110 via a user interface 140. The example sensors 112, 114, 116 mounted on and/or carried by the first watercraft 110 are utilized to track the second watercraft 120 to maintain the example threshold offset 150 between the first watercraft 110 and the second watercraft 120. In particular, the monitoring circuitry 130 utilizes the position information gathered by the sensors 112, 114, 116 to provide indications (e.g., recommendations) for the user/operator to adjust the position of the first watercraft 110 with respect to the second watercraft 120. In some examples, the provided indications are utilized by the user/operator to perform a desired operation (e.g., a maneuver, a course adjustment, etc.) and maintain the threshold offset 150. In some examples, the user interface 140 displays the indications and/or parameters to adjust the current operation of the first watercraft 110 to the desired operation of the first watercraft 110.

The monitoring circuitry 130 may be instantiated, implemented, or performed as described in connection with the processor circuitry of FIGS. 10-12. According to some examples disclosed herein, the monitoring circuitry 130 (e.g., utilizing computer vision software/applications) computes a three-dimensional (3D) position, orientation, and identity of the markers 122, 124 of the second watercraft 120 relative to the known and/or assumed locations of the sensors 112, 114, 116 carried by the first watercraft 110. Therefore, the example sensors 112, 114, 116 can be utilized to estimate the difference in headings and distance between the first watercraft 110 and the second watercraft 120 at one or more points along a side of the first watercraft 110 (e.g., sensor output is utilized to determine the relative headings and the relative distances between the first watercraft 110 and the second watercraft 120).

According to some examples disclosed herein, the first watercraft 110 and the second watercraft 120 may be a manned or unmanned surface vessel, such as a motorized vessel (e.g., a motorboat, a Boston whaler, a Heron Clearpath, an aircraft carrier, a battleship, a destroyer, a cruiser, a frigate, a corvette, a patrol boat, an auxiliary ship, or any other suitable vessel, etc.) or a non-motorized vessel (e.g., a rowboat, a dinghy, a raft, etc.) or any other suitable vessel and/or submersible. However, other watercraft and/or watercraft types may additionally or alternatively be utilized.

Figure 2:
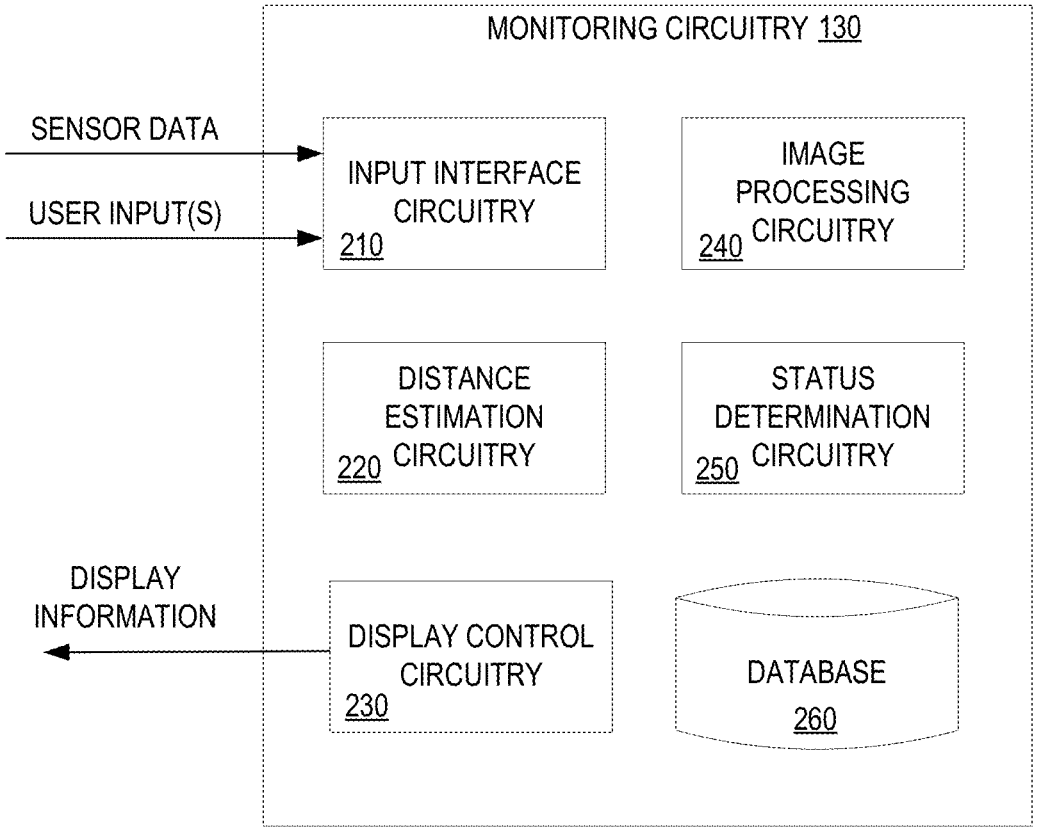
FIG. 2 is a block diagram of an example monitoring circuitry in accordance with teachings of this disclosure.

FIG. 2 is a block diagram representative of the example monitoring circuitry 130 of FIG. 1. The example monitoring circuitry 130 includes example input interface circuitry 210, example distance estimation circuitry 220, example display control circuitry 230, example image processing circuitry 240, example status determination circuitry 250, and an example database 260. FIG. 2 is an example implementation of the monitoring circuitry 130 of FIG. 1 to monitor a position of the first watercraft 110 in relation to a position of the second watercraft 120. The monitoring circuitry 130 of FIG. 2 may be instantiated (e.g., creating an instance of, bring into being for any length of time, materialize, implement, etc.) by programmable circuitry such as a Central Processor Unit (CPU) executing first instructions. Additionally or alternatively, the monitoring circuitry 130 of FIG. 2 may be instantiated (e.g., creating an instance of, bring into being for any length of time, materialize, implement, etc.) by (i) an Application Specific Integrated Circuit (ASIC) and/or (ii) a Field Programmable Gate Array (FPGA) structured and/or configured in response to execution of second instructions to perform operations corresponding to the first instructions. It should be understood that some or all of the circuitry of FIG. 2 may, thus, be instantiated at the same or different times. Some or all of the circuitry of FIG. 2 may be instantiated, for example, in one or more threads executing concurrently on hardware and/or in series on hardware. Moreover, in some examples, some or all of the circuitry of FIG. 2 may be implemented by microprocessor circuitry executing instructions and/or FPGA circuitry performing operations to implement one or more virtual machines and/or containers.

The monitoring circuitry 130 includes the example input interface circuitry 210. The example input interface circuitry 210 receives and/or accesses sensor data from the sensors 112, 114, 116 (shown in FIG. 1) and/or user input(s). In some examples, the sensor data may include visual data and/or range-finding data corresponding to positions of the markers 122, 124 on the second watercraft 120 and/or features of the second watercraft 120. In some examples, the input interface circuitry 210 may be further instantiated through connection to sensors or other image capturing devices. In some examples, the input interface circuitry 210 receives user input from an operator of the first watercraft 110 corresponding to desired watercraft navigation and/or operations. In some examples, an operator of the first watercraft 110 can utilize, via the input interface circuitry 210, a size and/or degree of the threshold offset 150 in conjunction with recommended and/or specified area of operation of the first watercraft 110, including, but not limited to, a recommended heading, a recommended speed, a recommended trajectory, etc. In some examples, the input interface circuitry 210 is instantiated by programmable circuitry executing input instructions and/or configured to perform operations such as those represented by the flowchart of FIG. 9.

The example monitoring circuitry 130 includes the distance estimation circuitry 220. In this example, the distance estimation circuitry 220 calculates a pose (e.g., a relative pose), which corresponds to a relative heading and/or a relative distance between the first watercraft 110 and the second watercraft 120. In this example, the pose is calculated by the distance estimation circuitry 220 based on the sensor data. In some examples, the distance estimation circuitry 220 calculates a relative speed between the first watercraft 110 and the second watercraft 120. In some examples, the distance estimation circuitry 220 utilizes sensor data collected by the sensors 112, 114, 116 and user inputs received by the input interface circuitry 210 to calculate a relative pose of the first watercraft 110 to the second watercraft 120 based on known or expected visual features and/or markers of the second watercraft 120.

In some examples, the distance estimation circuitry 220 computes the 3D position, orientation, and identity/designation of the markers 122, 124 of the second watercraft 120 relative to the known location of the sensors 112, 114, 116 positioned on the first watercraft 110. The example sensors 112, 114, 116 are located on and/or carried by the first watercraft 110 and are communicatively coupled to the monitoring circuitry 130. For example, the sensors 112, 114, 116 convey and/or provide a relative distance between the first watercraft 110 and the second watercraft 120, and/or a relative heading of the first watercraft 110 with respect to the second watercraft 120. The example sensors 112, 114, 116 can be implemented as a mobile device camera (e.g., a tablet camera, a mobile phone camera, etc.), a positional sensor, or other suitable position measurement device. While the example of FIG. 1 includes three sensors 112, 114, 116, in other examples, the functionality described herein may be performed by any other appropriate number of sensors including, but not limited to, one sensor, two sensors, or more than three sensors, etc.

As depicted in FIG. 1, the example markers 122, 124 are positioned on the second watercraft 120 and are detectable by the sensors 112, 114, 116 carried by the first watercraft 110. The markers 122, 124 may be AprilTags, ArUco, or any other suitable marker devices. In some examples, the markers 122, 124 are enabled to utilize OpenCV® software or other similar computer vision library programs. While the example of FIG. 1 includes two of the markers 122, 124 mounted on the second watercraft 120, one marker or more than two markers (e.g., three markers, four markers, five markers, ten markers, etc.) may be implemented instead.

According to examples disclosed herein, the distance estimation circuitry 220 estimates the difference in headings between and the distance between the first watercraft 110 and the second watercraft 120 at one or more points along a side of the first watercraft 110. By utilizing the difference in headings and distances between the first watercraft 110 and the second watercraft 120, known distances between sensors 112, 114, 116 on the first watercraft 110, and the known—or assumed—geometry of the first watercraft 110 and the second watercraft 120, a planar representation of the first watercraft 110 and the second watercraft 120 can be constructed and/or generated. In particular, the planar representation may be sent to the display control circuitry 230 to provide advanced visualization data to the user (e.g., operator, helmsman, etc.). In some examples, the distance estimation circuitry 220 is instantiated by programmable circuitry executing calculation instructions and/or configured to perform operations such as those represented by the flowchart of FIG. 9.

In this example, the monitoring circuitry 130 includes the display control circuitry 230. The example display control circuitry 230 provides information corresponding to the relative pose of the first watercraft 110 with respect to the second watercraft 120. In other words, the example display control circuitry 230 displays the position of the first watercraft 110 relative to the second watercraft 120. In some examples, the display control circuitry 230 may output the relative pose to a mobile device, a navigation panel on a vessel, and/or a desktop computer. Additionally, the display control circuitry 230 may enable and/or prompt the user to select a viewpoint for the display. In some examples, the user may select between two display options: (i) a top-down (e.g., eagle-eye) view or (ii) a front (e.g., perspective or first-person) view. In some such examples, the top-down view conveys an image of the first watercraft 110 and the second watercraft 120 relative to one another, such as for example, a desired location and orientation of the first watercraft 110 with respect to the second watercraft 120. Additionally or alternatively, the example display control circuitry 230 can depict a rectangular area (or other appropriately shaped area) to indicate the desired location and orientation of the watercraft. Additionally or alternatively, other methods of visual depiction of a position of the first watercraft 110 proximal to the second watercraft 120 may be utilized.

In some examples, the display control circuitry 230 may convey projected trajectories, target (e.g., desired) trajectories, and speeds of the first watercraft 110 and the second watercraft 120. In some examples, a projected trajectory (e.g., current trajectory) of the first watercraft 110 may be computed using a model and/or a spatial representation of the first watercraft 110, an estimate of a state/condition of a body of water in which the first watercraft 110 is located, a current orientation of the first watercraft 110, a rudder angle of the first watercraft 110, and/or a throttle position of the first watercraft 110.

In some examples, the display control circuitry 230 may display the planar representation of the first watercraft 110 relative to the second watercraft 120 with the user interface 140. In this example, the user interface 140 (e.g., an interface corresponding to a Decision Support Display) displays to the user of the first watercraft 110 an indication (e.g., a recommendation, a recommended movement and/or trajectory change, etc.) to adjust operation to either maintain or adjust the distance of the first watercraft 110 to the second watercraft 120 (e.g., adjust the first watercraft 110 to the threshold offset 150), and/or maintain or adjust a heading of the first watercraft 110 (e.g., to maintain the threshold offset 150). The example user interface 140 may be instantiated by a mobile device (e.g., a mobile phone, a tablet, a laptop, etc.), a watercraft navigation panel, a desktop computer, or any other suitable display panel. In some examples, the user interface 140 may wirelessly, or through wires, communicate with at least one sensor placed on the first watercraft through the monitoring circuitry 130. Additionally or alternatively, the user interface 140 may include a button, or other visual interface feature, to enable a user to switch between views and/or perspectives. In some examples, the user interface 140 may display desired and projected trajectories for the first watercraft 110 and/or the second watercraft 120, a recommended area of operation for the first watercraft 110 (e.g., recommended vehicle operation area), an indication of position of the first watercraft 110 (e.g., text stating status of the watercraft, color indications of the position of the watercraft, emission of alarms corresponding to the location of the watercraft, etc.), and/or the speed of the first watercraft 110 (e.g., a first speed) and the second watercraft 120 (e.g., a second speed).

Figure 9:
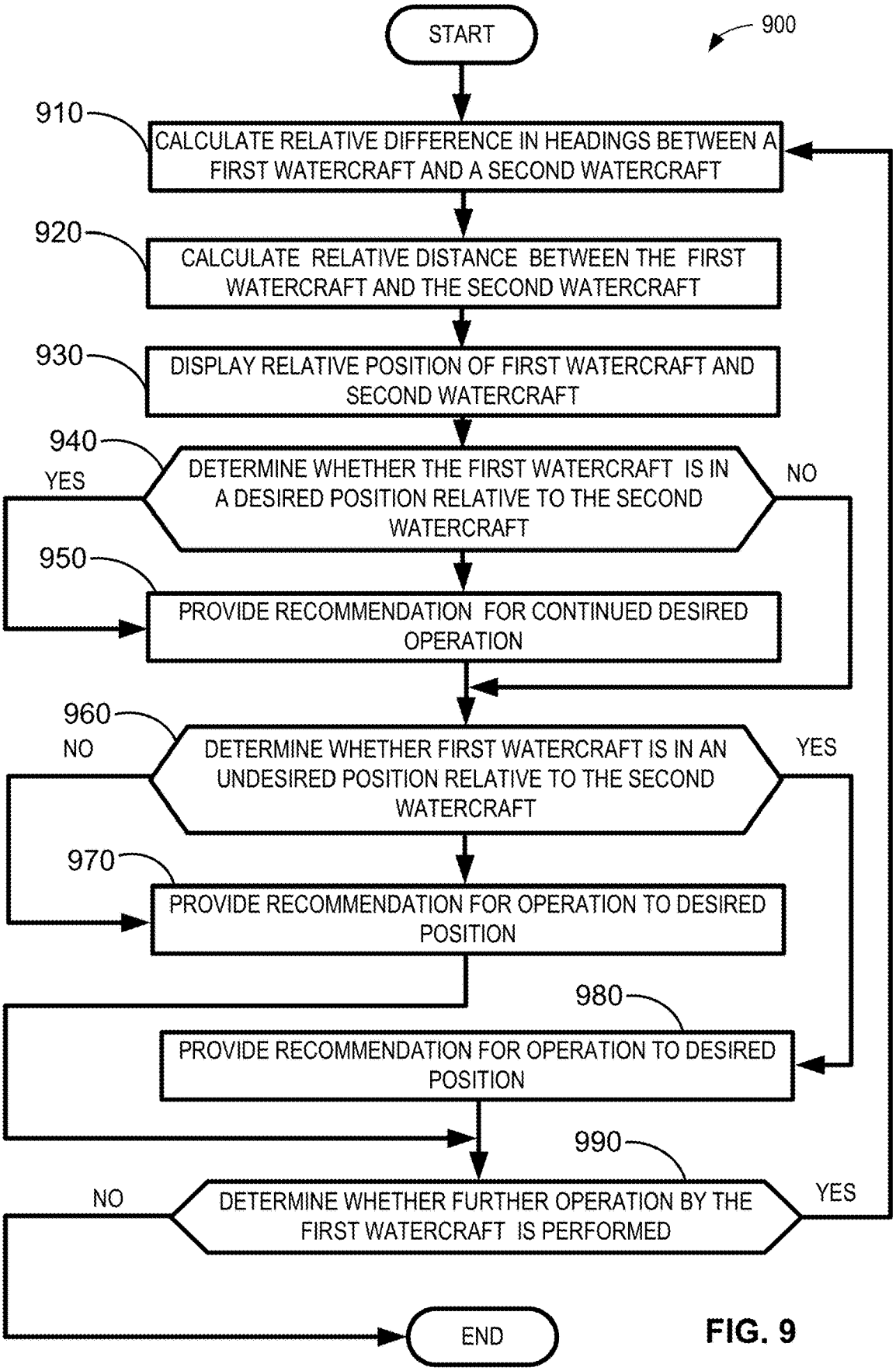
FIG. 9 is a flowchart representative of example machine-readable instructions and/or example operations that may be executed, instantiated, and/or performed by example programmable circuitry to implement the example monitoring circuitry of FIG. 2.

In some examples, the display control circuitry 230 is instantiated by programmable circuitry executing display instructions and/or configured to perform operations such as those represented by the flowchart of FIG. 9.

In some examples, the monitoring circuitry 130 includes the example image processing circuitry 240. In some such examples, the image processing circuitry 240 receives and/or accesses images obtained by the sensors 112, 114, 116 and processes the images for display by the display control circuitry 230. In some examples, the image processing circuitry 240 may further enhance or clarify images generated using the sensors 112, 114, 116. Additionally or alternatively, the image processing circuitry 240 can determine that the image is ready for display without further enhancement. In some examples, the image processing circuitry 240 may receive planar representations generated by the distance estimation circuitry 220 and synchronize the planar representations to an image for display on the user interface by the display control circuitry 230. In some examples, the image processing circuitry 240 is instantiated by programmable circuitry executing image processing instructions and/or configured to perform operations such as those represented by the flowchart of FIG. 9.

The monitoring circuitry 130 includes the example status determination circuitry 250. The example status determination circuitry 250 determines whether the first watercraft 110 is within or outside of the threshold offset 150 (shown in FIG. 1) from the second watercraft 120 based on information gathered by the sensors 112, 114, 116 and, based on a determination of a pose between the first watercraft 110 and the second watercraft 120, provides an indication (e.g., a recommendation) to adjust operation and/or movement of the first watercraft 110. The example threshold offset 150 can be measured between the first watercraft 110 and the second watercraft 120 to determine whether the first watercraft 110 is within the threshold offset 150 relative to the second watercraft 120. In some examples, the threshold offset 150 is defined by the desired operation of the first watercraft 110 and/or the second watercraft 120. In some examples, the threshold offset 150 includes markings at fixed distances to indicate the relative distance between the first watercraft 110 and the second watercraft 120. Accordingly, the example threshold offset 150 can correspond to the speed of the first watercraft 110 (e.g., a first speed) and the speed of the second watercraft 120 (e.g., a second speed), wherein the threshold offset 150 is measured between the watercraft 110, 120 during operation, for example. While the example of FIG. 1 displays a rectangular-shaped threshold offset 150, any other suitable shape (e.g., a line, a circle, a square, a parallelogram, an octagon, an oval, etc.) may implement the functionality associated with the threshold offset 150.

In some examples, the desired operation is underway replenishment. The term "underway replenishment" (i.e., "UNREP") refers to an operation, typically carried out by naval ships, to resupply a watercraft. In some instances, pulling a watercraft into port may be difficult, and, therefore, a replenishment operation performed on open water may be necessary. During a replenishment operation, the operators of multiple watercraft maintain a constant beam-to-beam distance and a constant speed. Therefore, the threshold offset 150 can be based on the desired operation of the first watercraft 110 and the second watercraft 120, and the relative sizes of the first watercraft 110 and the second watercraft 120. In some examples, the threshold offset 150 extends perpendicular from the second watercraft 120 and is displayed as a two-dimensional rectangular area between the first watercraft 110 and the second watercraft 120. In some such examples, the difference in headings between the first watercraft 110 and the second watercraft 120 may be determined by whether an edge (e.g., the nearest edge of the first watercraft 110 to the threshold offset 150) of the first watercraft 110 is parallel to the nearest edge of the threshold offset 150 to the first watercraft 110 of the threshold offset 150. If the edge of the threshold offset 150 and the edge of the first watercraft 110 are not parallel within a predetermined offset, then an adjustment may be required for the desired operation.

As described above, the determination of whether the first watercraft 110 is within the threshold offset 150 may, additionally or alternatively, include a determination that an edge (e.g., a closest edge to the threshold offset 150) of the first watercraft 110 is parallel to an edge (e.g., a closest edge to the first watercraft 110) of the threshold offset 150. In this example, a determination of whether the first watercraft 110 is traveling parallel to the threshold offset 150 may facilitate a determination of the heading of the first watercraft 110 relative to the second watercraft 120. As such, the threshold offset 150 may provide a visual indication to the user of the relative heading difference between the first watercraft 110 and the second watercraft 120. In some examples, the indication to adjust the operation of the watercraft 110 may include instructions to continue a current operation or to return (e.g., by a recommended path) to a desired trajectory. These instructions may be displayed to the user as suggested actions, such as, throttling up/down or turning left/right. Additionally, the status determination circuitry 250 may determine that the first watercraft 110 is within the threshold offset 150 from the second watercraft 120 and emit a warning and/or indication (e.g., an audible alarm and/or a visual signal) of the proximity of the first watercraft 110 and the second watercraft 120. The example status determination circuitry 250 can determine whether the first watercraft 110 has undertaken further operation from the most recent point where a measurement was taken. In some examples, the status determination circuitry 250 is instantiated by programmable circuitry executing status determination instructions and/or configured to perform operations such as those represented by the flowchart of FIG. 9.

The monitoring circuitry 130 is communicatively coupled to and/or includes the example database 260. The example database 260 stores desired operations and associated values (e.g., information corresponding to threshold offsets for different parameters and/or conditions, etc.) for use by the monitoring circuitry 130. Accordingly, the example database 260 can store various threshold offsets and recommended operations to maintain proper positional/heading offsets. While the example of FIG. 2 includes the single database 260, one or more databases may implement the functionality associated with the database 260. In some examples, the database 260 is instantiated by programmable circuitry executing access instructions and/or configured to perform operations such as those represented by the flowchart of FIG. 9.

While an example manner of implementing the monitoring circuitry 130 of FIG. 2 is illustrated in FIG. 2, one or more of the elements, processes, and/or devices illustrated in FIG. 2 may be combined, divided, re-arranged, omitted, eliminated, and/or implemented in any other way. Further, the input interface circuitry 210, the distance estimation circuitry 220, the display control circuitry 230, the image processing circuitry 240, the status determination circuitry 250, and/or, more generally, the example monitoring circuitry 130 of FIG. 2, may be implemented by hardware alone or by hardware in combination with software and/or firmware. Thus, for example, any of the input interface circuitry 210, the distance estimation circuitry 220, the display control circuitry 230, the image processing circuitry 240, the status determination circuitry 250, and/or, more generally, the example monitoring circuitry 130 of FIG. 2, could be implemented by programmable circuitry in combination with machine-readable instructions (e.g., firmware or software), processor circuitry, analog circuit(s), digital circuit(s), logic circuit(s), programmable processor(s), programmable microcontroller(s), graphics processing unit(s) (GPU(s)), digital signal processor(s) (DSP(s)), ASIC(s), programmable logic device(s) (PLD(s)), and/or field programmable logic device(s) (FPLD(s)) such as FPGAs. Further still, the example monitoring circuitry 130 of FIG. 2 may include one or more elements, processes, and/or devices in addition to, or instead of, those illustrated in FIG. 2, and/or may include more than one of any or all of the illustrated elements, processes and devices.

Figure 3:
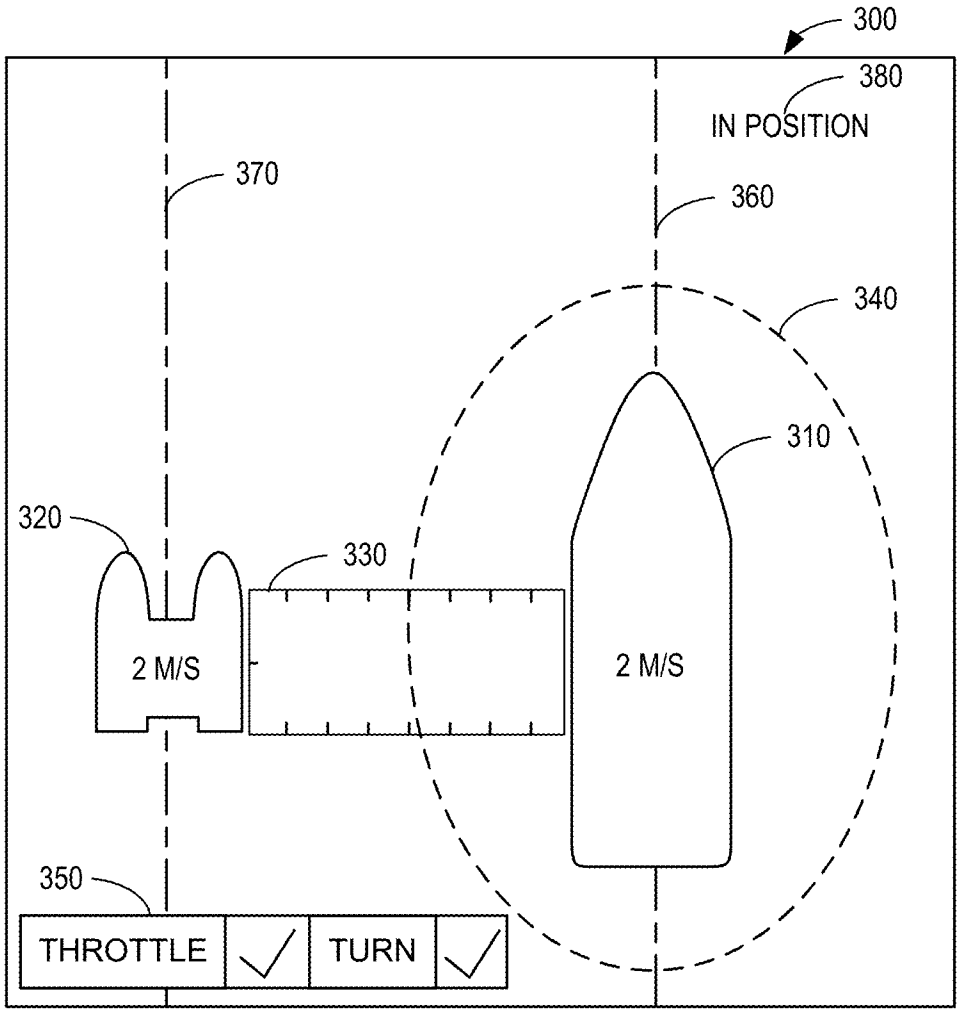
FIGS. 3-5 illustrate example operations that can be implemented in examples disclosed herein.
Figure 4:
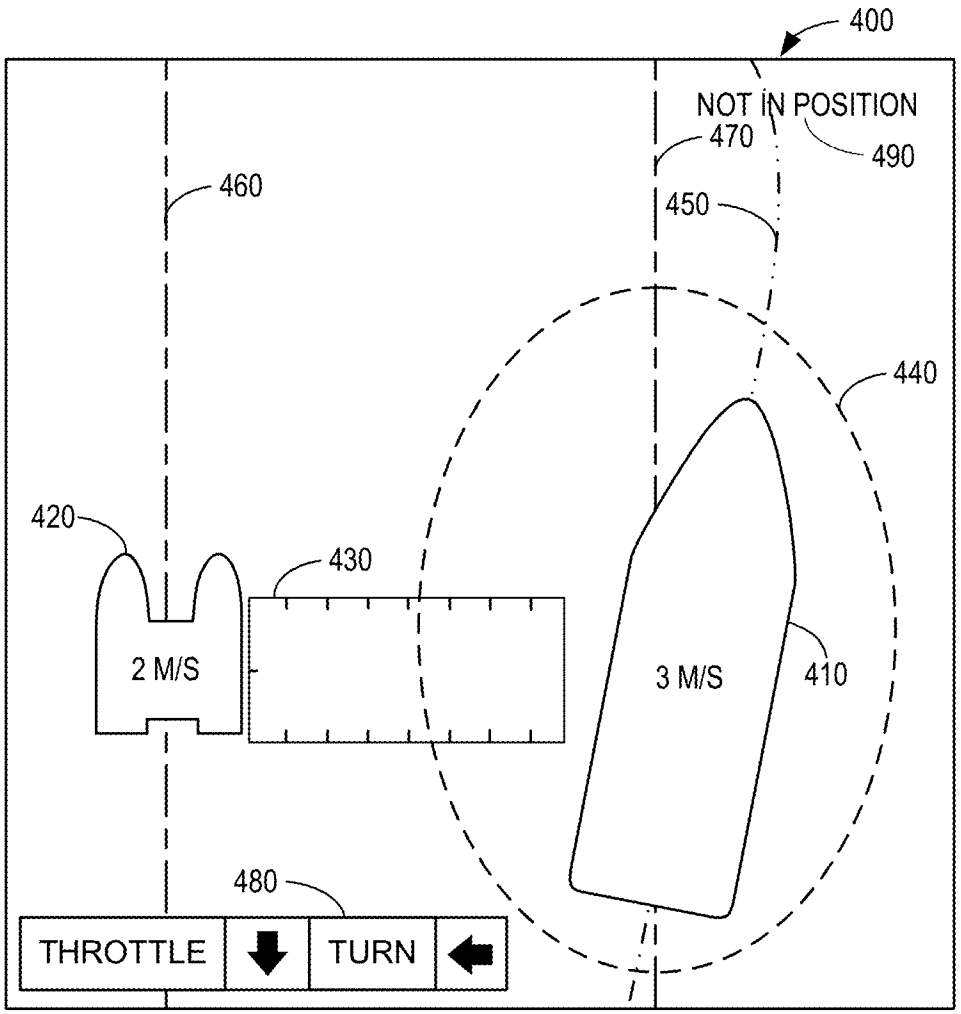
Figure 5:
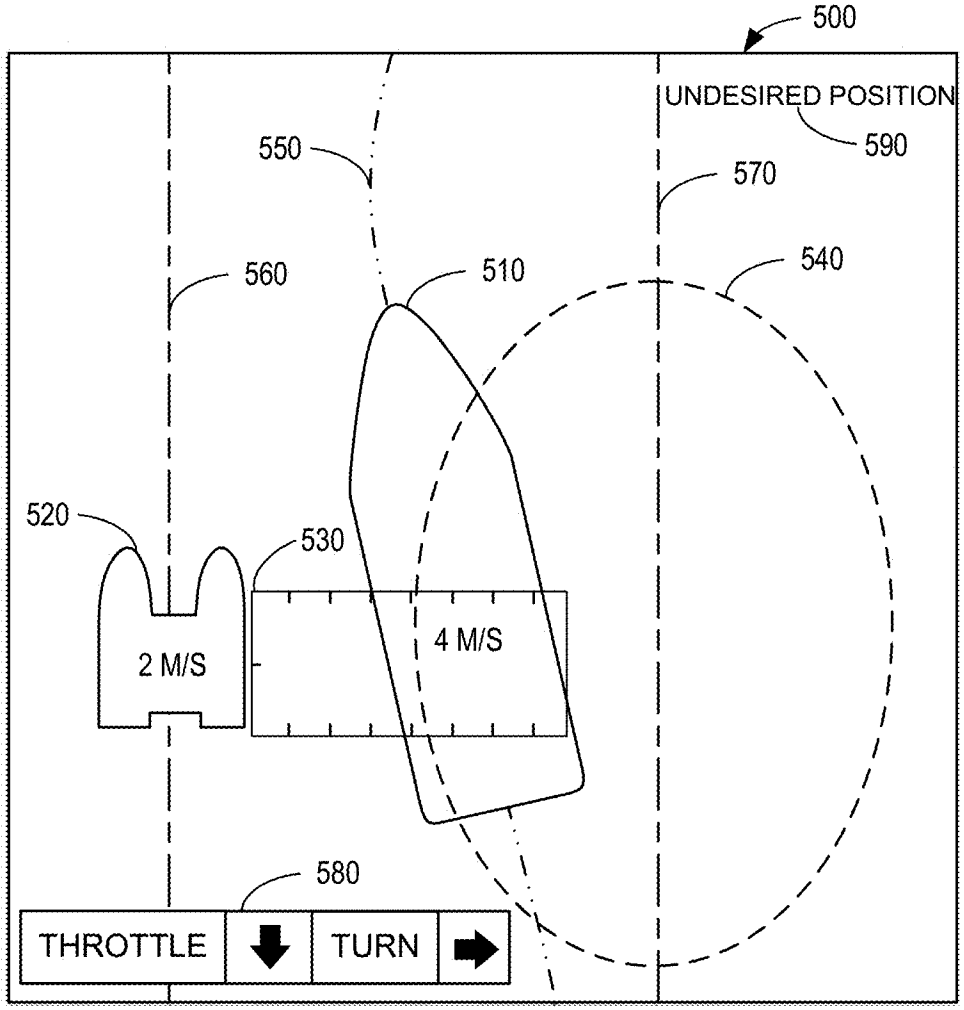

FIGS. 3-5 illustrate example operations that can be implemented in examples disclosed herein. Turning to FIG. 3, an example display 300 of a device (e.g., a mobile device) carried by, or otherwise incorporated into or as part of, a first watercraft 310 is depicted. The display 300 can be built-in, namely incorporated into, the first watercraft 310, or it can be portable and thus brought onto the first watercraft when desired. In this example, the first watercraft 310 is displayed on the display 300 in a top-down view with a second watercraft 320. In some examples, when the first watercraft 310 is in a desired and/or intended relative position, the first watercraft 310 may be illuminated by a color, such as green, to provide a visual indication to the operator. In other examples, when the first watercraft 310 is in a desired and/or intended relative position, the position of the first watercraft 310 may be represented by an icon, a symbol, a reticle, a displayed word, or a noise. The desired relative position is based on a threshold offset 330. Here, the first watercraft 310 is spaced the distance of the threshold offset 330 from the second watercraft 320, and the edge of the first watercraft 310 nearest to the threshold offset 330 is generally parallel to the threshold offset 330. In some examples, the first watercraft 310 may be surrounded by a zone of operation 340. The zone of operation 340 may represent the area in which the first watercraft 310 is located in relation to the second watercraft 320. Therefore, in this example, the first watercraft 310 is in a desired relative position. As a result of the desired relative position of the first watercraft 310, the indication 350 to adjust operation is to continue with the same speed and orientation.

Additionally, the example display 300 conveys the desired trajectory 360 of the first watercraft 310. In this example, the desired trajectory 360 is represented as the current path of the first watercraft because the first watercraft 310 is in a desired position relative to the second watercraft 320. However, in other examples, the desired trajectory may differ from a projected trajectory and may be represented by separate lines. In this example, the display 300 conveys a projected trajectory 370 for the second watercraft 320. In this example, the first watercraft 310 and the second watercraft 320 are displayed with their respective speeds. In some examples, the speed of the second watercraft 320 is measured by using a relative speed calculation between the vessels. Because the first watercraft 310 is in a desired position relative to the second watercraft 320, an indication 380 displays the status of the first watercraft as "IN POSITION."

FIG. 4 illustrates an example display 400 of a device (e.g., a mobile device) carried by, or otherwise incorporated into or as part of, the first watercraft 310. In this example, the first watercraft 310 is not in a desired and/or necessitated position with respect to the second watercraft 320 for the desired operation. In some examples, the first watercraft 310 may be outlined by a color, such as yellow, to indicate to the user that the first watercraft 310 is not in position. In other examples, when the first watercraft 310 is not in a desired and/or necessitated relative position, the position of the first watercraft 310 may be represented by an icon, a symbol, a reticle, a lettering, or a noise. In this example, the determination of the position of the first watercraft 310 is made by comparison to the second watercraft 320 and the aforementioned offset 330. As shown in this example, the first watercraft 310 is a recommended distance away from the second watercraft 320 as it is still within the zone of operation 340. However, in this example, the edge of the first watercraft 310 closest to the threshold offset 330 is not parallel to the threshold offset 330. As a result, a projected trajectory 450 of the first watercraft 310 places the first watercraft 310 outside of the recommended area of operation 340. Additionally, the first watercraft 310 is traveling at 3 meters per second (m/s) while the second watercraft 320 is traveling at 2 m/s. In some examples, the speed of the second watercraft 320 is determined by a relative speed comparison between the known speed (e.g., 3 m/s) of the first watercraft 310 to that of the second watercraft 320.

Additionally, the display 400 conveys a projected trajectory 460 of the second watercraft 320. Because of the determination that the first watercraft 310 is not in position, the display 400 conveys a desired trajectory 470 of the first watercraft 310 and one or more indications 480 to adjust operations by adjusting the current position of the first watercraft 310. In this example, the recommendations include decreasing the speed (e.g., to a recommended speed such as 2 m/s to match the second watercraft 320) and turning (in the view of FIG. 3) so as to align the heading of the first watercraft 310 with the desired trajectory 470. Because the first watercraft 310 is not in a desired position relative to the second watercraft 320, the indication 490 displays the status of the first watercraft as "NOT IN POSITION," for example.

FIG. 5 illustrates an example display 500 of a device (e.g., a mobile device) carried by or otherwise incorporated onto or as part of the first watercraft 310. In some examples, the first watercraft 310 may be outlined in a color, such as red, to indicate to the user that the first watercraft 310 is in an undesired position. In other examples, when the first watercraft 310 is in an undesired position, the position of the first watercraft 310 may be represented by an icon, a symbol, a reticle, a lettering, a noise or other indicator. The determination of an undesired position is based on the position of the first watercraft 310 relative to the second watercraft 320. Here, the first watercraft 310 is within a threshold offset 330 of the second watercraft 320. Additionally, the edge (e.g., the nearest edge to the threshold offset 330) of the first watercraft 310 is not parallel to the threshold offset 330. As a result of the position of the first watercraft 310, a projected trajectory 550 of the first watercraft 310 may cause the first watercraft 310 to contact the second watercraft 320 travelling along a projected trajectory 560 of the second watercraft 320. As the first watercraft 310 is outside the zone of operation 340, the status determination circuitry 250 determines that the first watercraft 310 is in an undesired position relative to the second watercraft 320. Based on this determination, indications 580 to adjust operation are provided to the user. Here, because the first watercraft 310 is traveling at 4 m/s and the second watercraft 320 is traveling at 2 m/s. The indications 580 to adjust operation recommend that the first watercraft slow down (e.g., to a recommended speed such as 2 m/s). Additionally, a desired trajectory 570 of the first watercraft 310 is separate from the first watercraft 310 (as shown in FIG. 5). As a result, the indications 580 to adjust operation convey a recommendation that the first watercraft 310 turn so as to align with the desired trajectory 570 (in the view of FIG. 5). Because the first watercraft 310 is not in a desired position relative to the second watercraft 320, an indication 590 displays the status of the first watercraft 310 as in an "UNDESIRED POSITION," for example. In some examples, the display 500 and/or the first watercraft 310 may emit a noise to alert the user to the position of the first watercraft 310.

Figure 6:
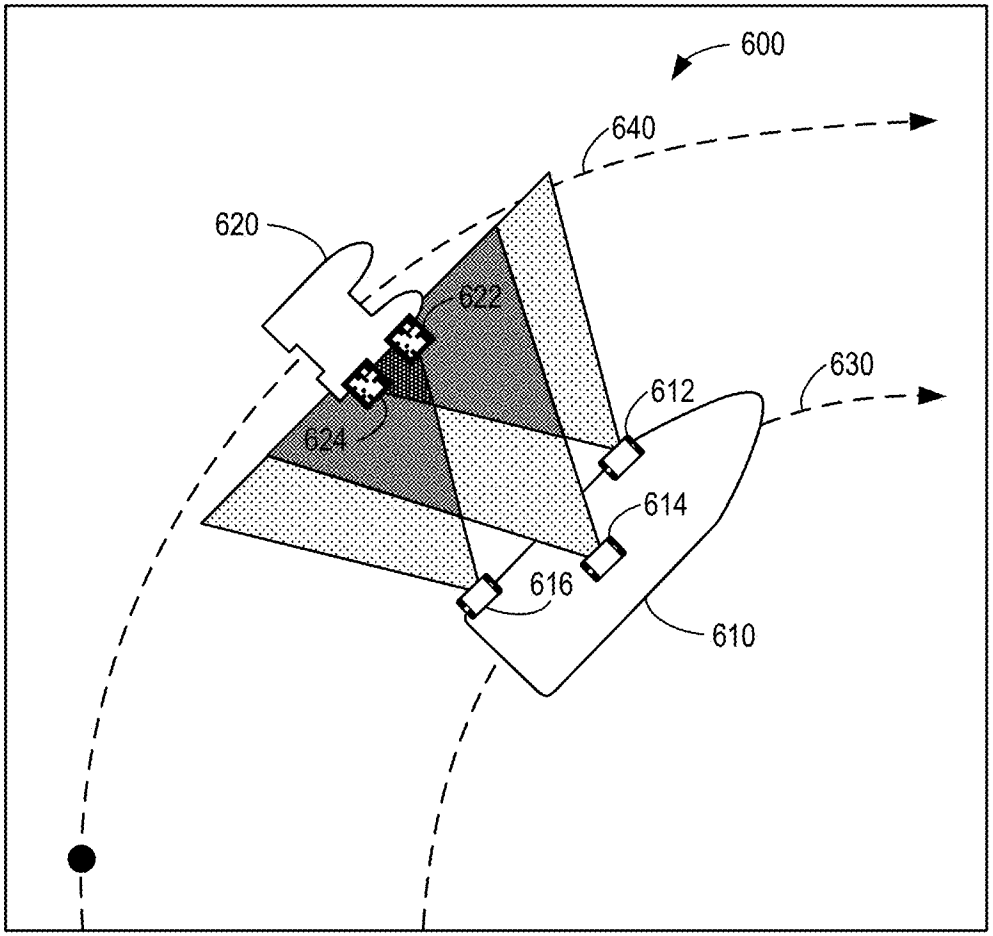
FIGS. 6-7 are overhead views illustrating example operations of examples disclosed herein.
Figure 7:
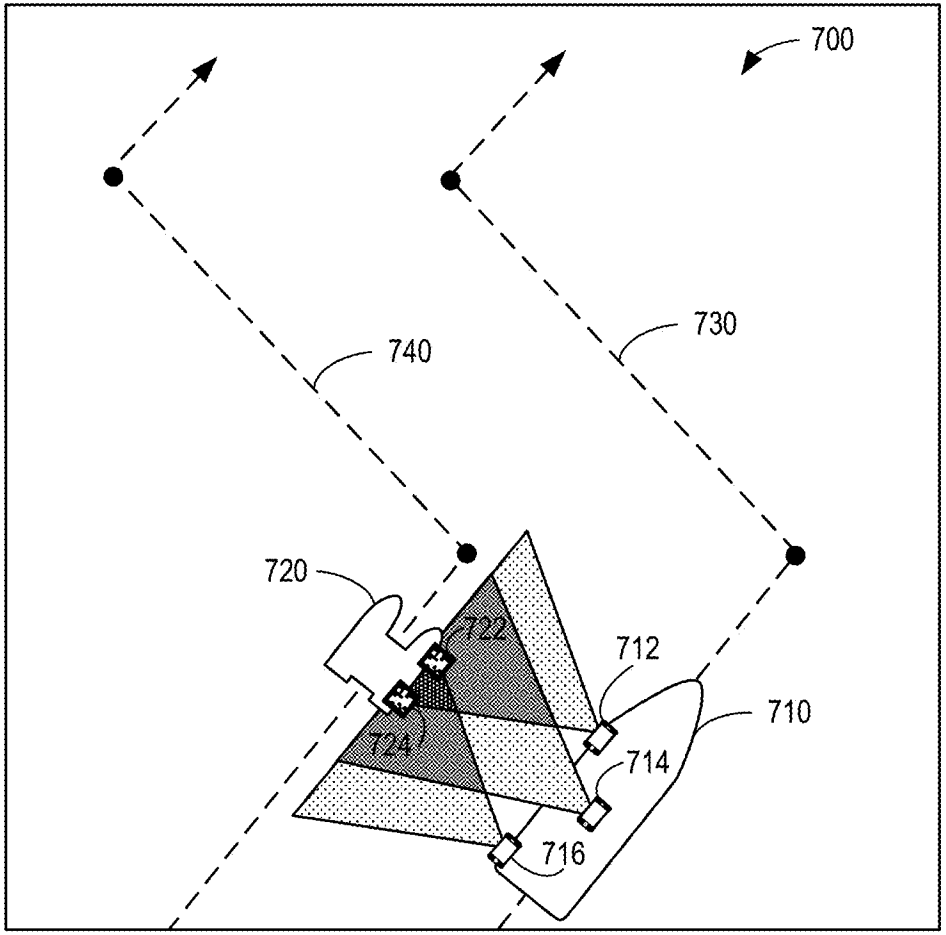

FIGS. 6-7 are overhead views illustrating example operations of examples disclosed herein. Turning to FIG. 6, an example operation 600 that may be performed by the first watercraft 310 and the second watercraft 320 is depicted. In this example, the first watercraft 310 includes the three sensors 112, 114, 116 and the second watercraft 320 includes the two markers 122, 124. While three sensors 112, 114, 116 and two markers 122, 124 are depicted in this example, varying numbers of sensors and markers may be used in the implementations disclosed herein. As a result of the sensors 112, 114, 116 tracking the markers 122, 124 on the second watercraft 320 as the second watercraft 320 travels along a projected trajectory 640, indications to adjust operation may be generated for the first watercraft 310 to follow a similar projected trajectory 630. In some examples, the second watercraft 320 may maintain a constant speed and constant turn rate for the first watercraft 310 to track.

FIG. 7 is an example operation 700 that may be performed by the first watercraft 310 and the second watercraft 320. In this example, the first watercraft 310 includes the three sensors 112, 114, 116. The example second watercraft 320 includes the two markers 122, 124. While three sensors 112, 114, 116 and two markers 122, 124 are depicted in this example, varying numbers of sensors and markers may be used in the implementations disclosed herein. As a result of the sensors 112, 114, 116 being utilized to track the markers 122, 124 on the second watercraft 320 as the second watercraft 320 travels along a projected trajectory 740, indications to adjust operation may be generated for the first watercraft 310 to travel along a projected trajectory 730. In this example, the second watercraft 320 is traveling in a "zig-zag" pattern for the first watercraft 310 to track the second watercraft 320.

Figure 8:
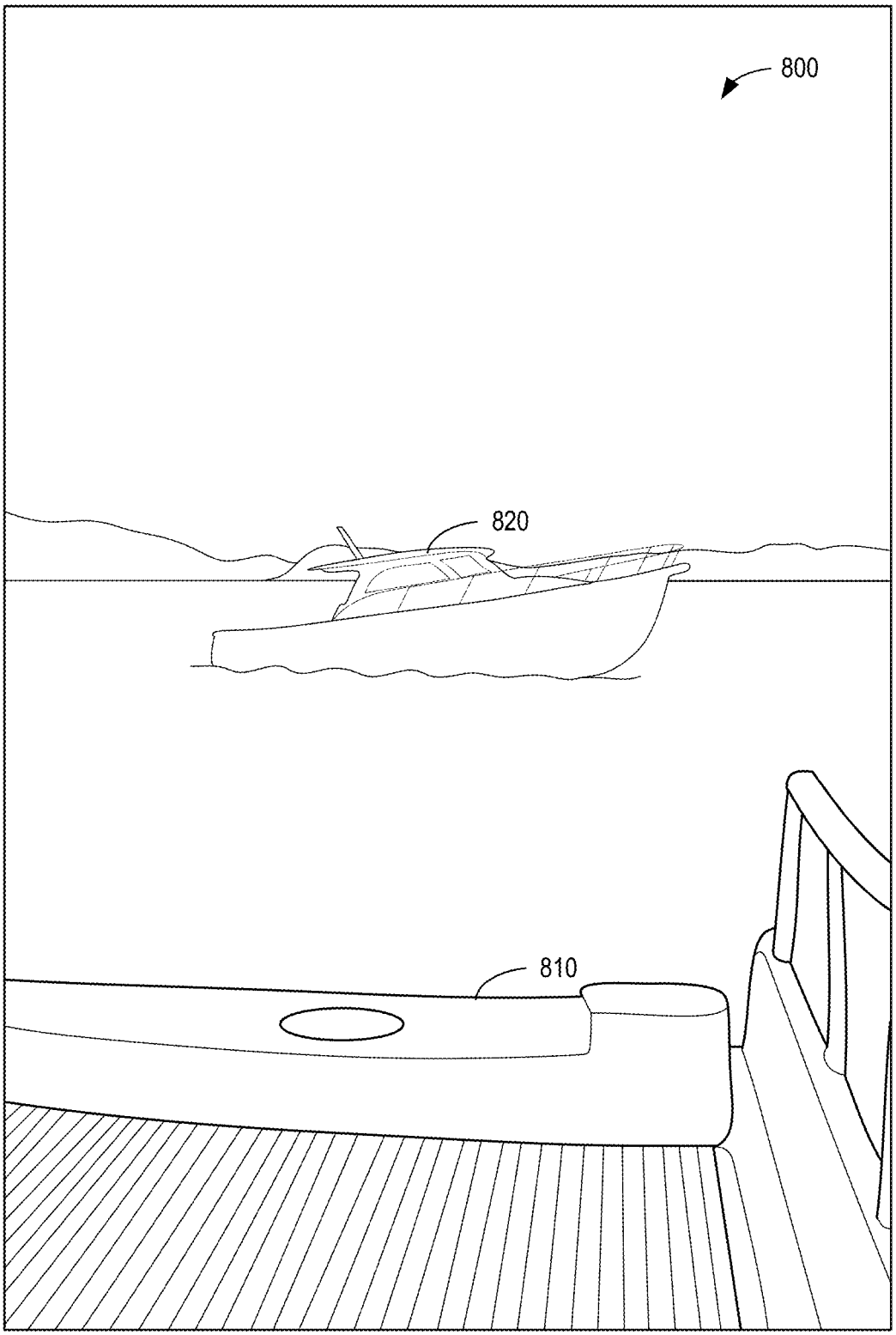
FIG. 8 is an example perspective view shown on a display that can be implemented in examples as disclosed herein.

FIG. 8 is an example perspective view 800 that may alternatively be selected by a user via the user interface 140 of FIG. 1. In this example, sensors of the first watercraft 310 may alternatively be utilized to generate images from a perspective view of the second watercraft 320. In some examples, a button, or other suitable interface feature, may appear on the display of FIGS. 3-5 to switch between the top-down view (shown in FIGS. 3-5) and the perspective view 800.

A flowchart representative of example machine-readable instructions, which may be executed by programmable circuitry to implement and/or instantiate the monitoring circuitry 130 of FIG. 2 and/or representative of example operations which may be performed by programmable circuitry to implement and/or instantiate the monitoring circuitry 130 of FIG. 2, is shown in FIG. 9. The machine-readable instructions may be one or more executable programs or portion(s) of one or more executable programs for execution by programmable circuitry such as the programmable circuitry 1012 shown in the example processor platform 1000 discussed below in connection with FIG. 10 and/or may be one or more function(s) or portion(s) of functions to be performed by the example programmable circuitry (e.g., an FPGA) discussed below in connection with FIGS. 11 and/or 12. In some examples, the machine-readable instructions cause an operation, a task, etc., to be carried out and/or performed in an automated manner in the real world. As used herein, "automated" means without human involvement.

The program may be embodied in instructions (e.g., software and/or firmware) stored on one or more non-transitory computer readable and/or machine-readable storage medium such as cache memory, a magnetic-storage device or disk (e.g., a floppy disk, a Hard Disk Drive (HDD), etc.), an optical-storage device or disk (e.g., a Blu-ray disk, a Compact Disk (CD), a Digital Versatile Disk (DVD), etc.), a Redundant Array of Independent Disks (RAID), a register, ROM, a solid-state drive (SSD), SSD memory, non-volatile memory (e.g., electrically erasable programmable read-only memory (EEPROM), flash memory, etc.), volatile memory (e.g., Random Access Memory (RAM) of any type, etc.), and/or any other storage device or storage disk. The instructions of the non-transitory computer readable and/or machine-readable medium may program and/or be executed by programmable circuitry located in one or more hardware devices, but the entire program and/or parts thereof could alternatively be executed and/or instantiated by one or more hardware devices other than the programmable circuitry and/or embodied in dedicated hardware. The machine-readable instructions may be distributed across multiple hardware devices and/or executed by two or more hardware devices (e.g., a server and a client hardware device). For example, the client hardware device may be implemented by an endpoint client hardware device (e.g., a hardware device associated with a human and/or machine user) or an intermediate client hardware device gateway (e.g., a radio access network (RAN)) that may facilitate communication between a server and an endpoint client hardware device. Similarly, the non-transitory computer readable storage medium may include one or more mediums. Further, although the example program is described with reference to the flowchart illustrated in FIG. 9, many other methods of implementing the example monitoring circuitry 130 may alternatively be used. For example, the order of execution of the blocks of the flowchart may be changed, and/or some of the blocks described may be changed, eliminated, or combined. Additionally or alternatively, any or all of the blocks of the flowchart may be implemented by one or more hardware circuits (e.g., processor circuitry, discrete and/or integrated analog and/or digital circuitry, an FPGA, an ASIC, a comparator, an operational-amplifier (op-amp), a logic circuit, etc.) structured to perform the corresponding operation without executing software or firmware. The programmable circuitry may be distributed in different network locations and/or local to one or more hardware devices (e.g., a single-core processor (e.g., a single core CPU), a multi-core processor (e.g., a multi-core CPU, an XPU, etc.)). For example, the programmable circuitry may be a CPU and/or an FPGA located in the same package (e.g., the same integrated circuit (IC) package or in two or more separate housings), one or more processors in a single machine, multiple processors distributed across multiple servers of a server rack, multiple processors distributed across one or more server racks, etc., and/or any combination(s) thereof.

The machine-readable instructions described herein may be stored in one or more of a compressed format, an encrypted format, a fragmented format, a compiled format, an executable format, a packaged format, etc. Machine-readable instructions as described herein may be stored as data (e.g., computer-readable data, machine-readable data, one or more bits (e.g., one or more computer-readable bits, one or more machine-readable bits, etc.), a bitstream (e.g., a computer-readable bitstream, a machine-readable bitstream, etc.), etc.) or a data structure (e.g., as portion(s) of instructions, code, representations of code, etc.) that may be utilized to create, manufacture, and/or produce machine executable instructions. For example, the machine-readable instructions may be fragmented and stored on one or more storage devices, disks and/or computing devices (e.g., servers) located at the same or different locations of a network or collection of networks (e.g., in the cloud, in edge devices, etc.). The machine-readable instructions may require one or more of installation, modification, adaptation, updating, combining, supplementing, configuring, decryption, decompression, unpacking, distribution, reassignment, compilation, etc., in order to make them directly readable, interpretable, and/or executable by a computing device and/or other machine. For example, the machine-readable instructions may be stored in multiple parts, which are individually compressed, encrypted, and/or stored on separate computing devices, wherein the parts when decrypted, decompressed, and/or combined form a set of computer-executable and/or machine executable instructions that implement one or more functions and/or operations that may together form a program such as that described herein.

In another example, the machine-readable instructions may be stored in a state in which they may be read by programmable circuitry, but require addition of a library (e.g., a dynamic link library (DLL)), a software development kit (SDK), an application programming interface (API), etc., in order to execute the machine-readable instructions on a particular computing device or other device. In another example, the machine-readable instructions may need to be configured (e.g., settings stored, data input, network addresses recorded, etc.) before the machine-readable instructions and/or the corresponding program(s) can be executed in whole or in part. Thus, machine-readable, computer readable and/or machine-readable media, as used herein, may include instructions and/or program(s) regardless of the particular format or state of the machine-readable instructions and/or program(s).

The machine-readable instructions described herein can be represented by any past, present, or future instruction language, scripting language, programming language, etc. For example, the machine-readable instructions may be represented using any of the following languages: C, C++, Java, C#, Perl, Python, JavaScript, HyperText Markup Language (HTML), Structured Query Language (SQL), Swift, etc.

As mentioned above, the example operations of FIG. 9 may be implemented using executable instructions (e.g., computer readable and/or machine-readable instructions) stored on one or more non-transitory computer readable and/or machine-readable media. As used herein, the terms non-transitory computer readable medium, non-transitory computer readable storage medium, non-transitory machine-readable medium, and/or non-transitory machine-readable storage medium are expressly defined to include any type of computer readable storage device and/or storage disk and to exclude propagating signals and to exclude transmission media. Examples of such non-transitory computer readable medium, non-transitory computer readable storage medium, non-transitory machine-readable medium, and/or non-transitory machine-readable storage medium include optical storage devices, magnetic storage devices, an HDD, a flash memory, a read-only memory (ROM), a CD, a DVD, a cache, a RAM of any type, a register, and/or any other storage device or storage disk in which information is stored for any duration (e.g., for extended time periods, permanently, for brief instances, for temporarily buffering, and/or for caching of the information). As used herein, the terms "non-transitory computer readable storage device" and "non-transitory machine-readable storage device" are defined to include any physical (mechanical, magnetic and/or electrical) hardware to retain information for a time period, but to exclude propagating signals and to exclude transmission media. Examples of non-transitory computer readable storage devices and/or non-transitory machine-readable storage devices include random access memory of any type, read only memory of any type, solid state memory, flash memory, optical discs, magnetic disks, disk drives, and/or redundant array of independent disks (RAID) systems. As used herein, the term "device" refers to physical structure such as mechanical and/or electrical equipment, hardware, and/or circuitry that may or may not be configured by computer readable instructions, machine-readable instructions, etc., and/or manufactured to execute computer-readable instructions, machine-readable instructions, etc.

FIG. 9 is a flowchart representative of example machine-readable instructions and/or example operations 900 that may be executed, instantiated, and/or performed by programmable circuitry to provide recommendations for operation of the first watercraft. The example machine-readable instructions and/or the example operations 900 of FIG. 9 begin at block 910, at which the input interface circuitry 210 provides sensor readings of the second watercraft to the distance estimation circuitry 220 to calculate a relative difference in headings between the first watercraft and the second watercraft.

At block 920, the input interface circuitry 210 of the illustrated example provides sensor readings of the second watercraft to the distance estimation circuitry 220 to calculate the relative pose between the first watercraft and the second watercraft.

In this example, after the relative pose between the first watercraft and the second watercraft is calculated, the images are processed by the example image processing circuitry 240 and displayed to show the relative pose of the first watercraft and the second watercraft (block 930) by the display control circuitry 230.

At block 940, the example status determination circuitry 250 determines whether the first watercraft is in a desired position relative to the second watercraft. If the status determination circuitry 250 determines that the first watercraft is in a desired position relative to the second watercraft (block 940: YES), a recommendation is provided for continued desired operation (block 950).

However, if it is determined that the first watercraft is not in a desired position relative to the second watercraft (block 940: NO), control proceeds to block 960.

At block 960, the example status determination circuitry 250 determines whether the first watercraft is an undesired position relative to the second watercraft. If the status determination circuitry 250 determines that the first watercraft is not in an undesired position relative to the second watercraft (block 960: NO), a first recommendation is provided by the status determination circuitry 250 for operation to a desired position (block 970). In some examples, the first watercraft may not be in an undesired operation but still require adjustment to the desired operation when the first watercraft is in the recommended area of operation but at a skewed heading from the second watercraft, or when the first watercraft is traveling too fast as compared to the second watercraft.

However, if the status determination circuitry 250 determines that the first watercraft is in an undesired position relative to the second watercraft (block 960: YES), a second recommendation is provided by the status determination circuitry 250 for operation to the desired position (block 980). In some examples, when the status determination circuitry 250 determines that the first watercraft is in an undesired position, it may cause an alarm or an indication to be provided to alert the operator to the position of the vessel. In some examples, the alarm and/or the indication may be visual and/or aural.

After the status determination circuitry provides a first recommendation (block 970) or a second recommendation (block 980), control proceeds to block 990 where the example status determination circuitry 250 determines whether the first watercraft has changed position relative to the second watercraft. In this example, the status determination circuitry 250 determines whether the first watercraft has changed position relative to the second watercraft based on a prior measurement of the relative heading difference and pose between the watercraft. If the status determination circuitry 250 determines that further operation has been performed (block 990: YES), the process returns to block 910. However, if the status determination circuitry 250 determines that further operation has not been performed (block 990: NO), the process ends.

Figure 10:
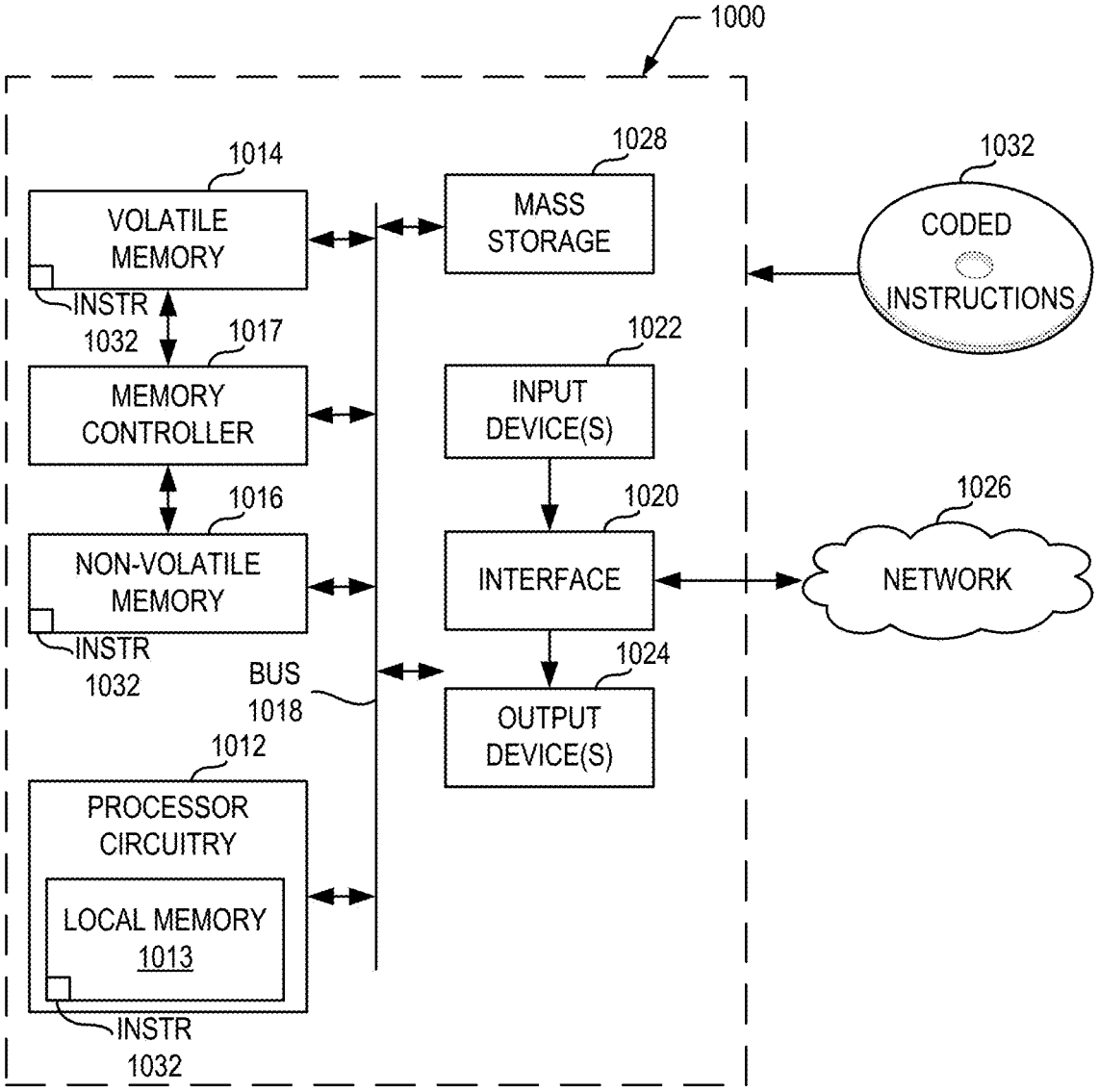
FIG. 10 is a block diagram of an example processing platform including programmable circuitry structured to execute, instantiate, and/or perform the example machine-readable instructions and/or perform the example operations of FIG. 9 to implement the example monitoring circuitry of FIG. 2.

FIG. 10 is a block diagram of an example programmable circuitry platform 1000 structured to execute and/or instantiate the example machine-readable instructions and/or the example operations of FIG. 9 to implement the monitoring circuitry 130 of FIG. 2. The programmable circuitry platform 1000 can be, for example, a server, a personal computer, a workstation, a self-learning machine (e.g., a neural network), a mobile device (e.g., a cell phone, a smart phone, a tablet such as an iPad™), a personal digital assistant (PDA), an Internet appliance, a DVD player, a CD player, a digital video recorder, a Blu-ray player, a gaming console, a personal video recorder, a set top box, a headset (e.g., an augmented reality (AR) headset, a virtual reality (VR) headset, etc.) or other wearable device, or any other type of computing and/or electronic device.

The programmable circuitry platform 1000 of the illustrated example includes programmable circuitry 1012. The programmable circuitry 1012 of the illustrated example is hardware. For example, the programmable circuitry 1012 can be implemented by one or more integrated circuits, logic circuits, FPGAs, microprocessors, CPUs, GPUs, DSPs, and/or microcontrollers from any desired family or manufacturer. The programmable circuitry 1012 may be implemented by one or more semiconductor based (e.g., silicon based) devices. In this example, the programmable circuitry 1012 implements the input interface circuitry 210, the distance estimation circuitry 220, the display control circuitry 230, the image processing circuitry 240, and the status determination circuitry 250.

The programmable circuitry 1012 of the illustrated example includes a local memory 1013 (e.g., a cache, registers, etc.). The programmable circuitry 1012 of the illustrated example is in communication with main memory 1014, 1016, which includes a volatile memory 1014 and a non-volatile memory 1016, by a bus 1018. The volatile memory 1014 may be implemented by Synchronous Dynamic Random Access Memory (SDRAM), Dynamic Random Access Memory (DRAM), RAMBUS® Dynamic Random Access Memory (RDRAM®), and/or any other type of RAM device. The non-volatile memory 1016 may be implemented by flash memory and/or any other desired type of memory device. Access to the main memory 1014, 1016 of the illustrated example is controlled by a memory controller 1017. In some examples, the memory controller 1017 may be implemented by one or more integrated circuits, logic circuits, microcontrollers from any desired family or manufacturer, or any other type of circuitry to manage the flow of data going to and from the main memory 1014, 1016.

The programmable circuitry platform 1000 of the illustrated example also includes interface circuitry 1020. The interface circuitry 1020 may be implemented by hardware in accordance with any type of interface standard, such as an Ethernet interface, a universal serial bus (USB) interface, a Bluetooth® interface, a near field communication (NFC) interface, a Peripheral Component Interconnect (PCI) interface, and/or a Peripheral Component Interconnect Express (PCIe) interface.

In the illustrated example, one or more input devices 1022 are connected to the interface circuitry 1020. The input device(s) 1022 permit(s) a user (e.g., a human user, a machine user, etc.) to enter data and/or commands into the programmable circuitry 1012. The input device(s) 1022 can be implemented by, for example, an audio sensor, a microphone, a camera (still or video), a keyboard, a button, a mouse, a touchscreen, a trackpad, a trackball, an isopoint device, and/or a voice recognition system.

One or more output devices 1024 are also connected to the interface circuitry 1020 of the illustrated example. The output device(s) 1024 can be implemented, for example, by display devices (e.g., a light emitting diode (LED), an organic light emitting diode (OLED), a liquid crystal display (LCD), a cathode ray tube (CRT) display, an in-place switching (IPS) display, a touchscreen, etc.), a tactile output device, a printer, and/or speaker. The interface circuitry 1020 of the illustrated example, thus, typically includes a graphics driver card, a graphics driver chip, and/or graphics processor circuitry such as a GPU.

The interface circuitry 1020 of the illustrated example also includes a communication device such as a transmitter, a receiver, a transceiver, a modem, a residential gateway, a wireless access point, and/or a network interface to facilitate exchange of data with external machines (e.g., computing devices of any kind) by a network 1026. The communication can be by, for example, an Ethernet connection, a digital subscriber line (DSL) connection, a telephone line connection, a coaxial cable system, a satellite system, a beyond-line-of-sight wireless system, a line-of-sight wireless system, a cellular telephone system, an optical connection, etc.

The programmable circuitry platform 1000 of the illustrated example also includes one or more mass storage discs or devices 1028 to store firmware, software, and/or data. Examples of such mass storage discs or devices 1028 include magnetic storage devices (e.g., floppy disk, drives, HDDs, etc.), optical storage devices (e.g., Blu-ray disks, CDs, DVDs, etc.), RAID systems, and/or solid-state storage discs or devices such as flash memory devices and/or SSDs.

The machine-readable instructions 1032, which may be implemented by the machine-readable instructions of FIG. 9, may be stored in the mass storage device 1028, in the volatile memory 1014, in the non-volatile memory 1016, and/or on at least one non-transitory computer readable storage medium such as a CD or DVD which may be removable.

Figure 11:
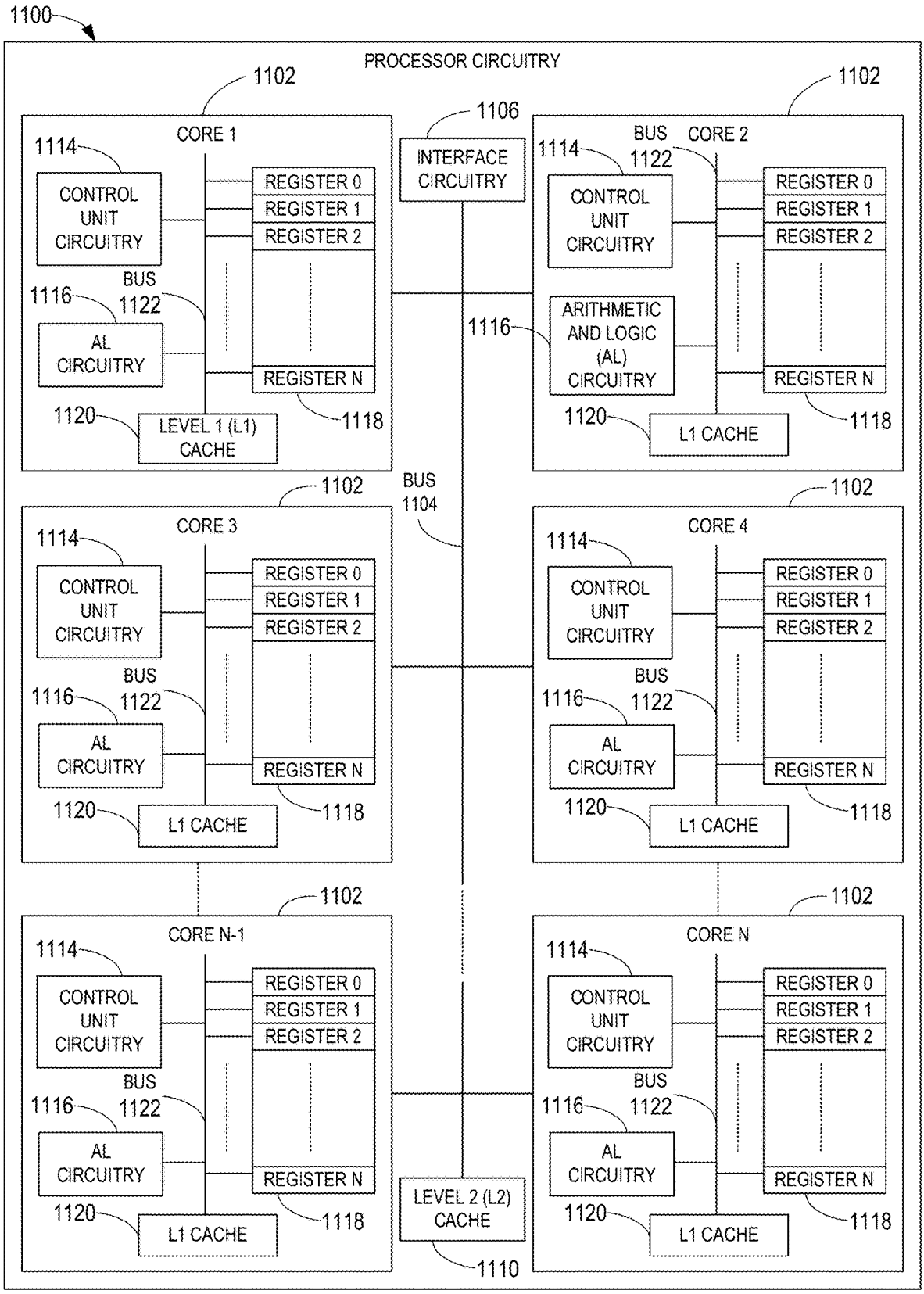
FIG. 11 is a block diagram of an example implementation of the programmable circuitry of FIG. 10.

FIG. 11 is a block diagram of an example implementation of the programmable circuitry 1012 of FIG. 10. In this example, the programmable circuitry 1012 of FIG. 10 is implemented by a microprocessor 1100. For example, the microprocessor 1100 may be a general-purpose microprocessor (e.g., general-purpose microprocessor circuitry). The microprocessor 1100 executes some or all of the machine-readable instructions of the flowchart of FIG. 9 to effectively instantiate the circuitry of FIG. 2 as logic circuits to perform operations corresponding to those machine-readable instructions. In some such examples, the circuitry of FIG. 2 is instantiated by the hardware circuits of the microprocessor 1100 in combination with the machine-readable instructions. For example, the microprocessor 1100 may be implemented by multi-core hardware circuitry such as a CPU, a DSP, a GPU, an XPU, etc. Although it may include any number of example cores 1102 (e.g., 1 core), the microprocessor 1100 of this example is a multi-core semiconductor device including N cores. The cores 1102 of the microprocessor 1100 may operate independently or may cooperate to execute machine-readable instructions. For example, machine code corresponding to a firmware program, an embedded software program, or a software program may be executed by one of the cores 1102 or may be executed by multiple ones of the cores 1102 at the same or different times. In some examples, the machine code corresponding to the firmware program, the embedded software program, or the software program is split into threads and executed in parallel by two or more of the cores 1102. The software program may correspond to a portion or all of the machine-readable instructions and/or operations represented by the flowchart of FIG. 9.

The cores 1102 may communicate by a first example bus 1104. In some examples, the first bus 1104 may be implemented by a communication bus to effectuate communication associated with one(s) of the cores 1102. For example, the first bus 1104 may be implemented by at least one of an Inter-Integrated Circuit (I2C) bus, a Serial Peripheral Interface (SPI) bus, a PCI bus, or a PCIe bus. Additionally or alternatively, the first bus 1104 may be implemented by any other type of computing or electrical bus. The cores 1102 may obtain data, instructions, and/or signals from one or more external devices by example interface circuitry 1106. The cores 1102 may output data, instructions, and/or signals to the one or more external devices by the interface circuitry 1106. Although the cores 1102 of this example include example local memory 1120 (e.g., Level 1 (L1) cache that may be split into an L1 data cache and an L1 instruction cache), the microprocessor 1100 also includes example shared memory 1110 that may be shared by the cores (e.g., Level 2 (L2 cache)) for high-speed access to data and/or instructions. Data and/or instructions may be transferred (e.g., shared) by writing to and/or reading from the shared memory 1110. The local memory 1120 of each of the cores 1102 and the shared memory 1110 may be part of a hierarchy of storage devices including multiple levels of cache memory and the main memory (e.g., the main memory 1014, 1016 of FIG. 10). Typically, higher levels of memory in the hierarchy exhibit lower access time and have smaller storage capacity than lower levels of memory. Changes in the various levels of the cache hierarchy are managed (e.g., coordinated) by a cache coherency policy.

Each core 1102 may be referred to as a CPU, DSP, GPU, etc., or any other type of hardware circuitry. Each core 1102 includes control unit circuitry 1114, arithmetic and logic (AL) circuitry (sometimes referred to as an ALU) 1116, a plurality of registers 1118, the local memory 1120, and a second example bus 1122. Other structures may be present. For example, each core 1102 may include vector unit circuitry, single instruction multiple data (SIMD) unit circuitry, load/store unit (LSU) circuitry, branch/jump unit circuitry, floating-point unit (FPU) circuitry, etc. The control unit circuitry 1114 includes semiconductor-based circuits structured to control (e.g., coordinate) data movement within the corresponding core 1102. The AL circuitry 1116 includes semiconductor-based circuits structured to perform one or more mathematic and/or logic operations on the data within the corresponding core 1102. The AL circuitry 1116 of some examples performs integer based operations. In other examples, the AL circuitry 1116 also performs floating-point operations. In yet other examples, the AL circuitry 1116 may include first AL circuitry that performs integer-based operations and second AL circuitry that performs floating-point operations. In some examples, the AL circuitry 1116 may be referred to as an Arithmetic Logic Unit (ALU).

The registers 1118 are semiconductor-based structures to store data and/or instructions such as results of one or more of the operations performed by the AL circuitry 1116 of the corresponding core 1102. For example, the registers 1118 may include vector register(s), SIMD register(s), general-purpose register(s), flag register(s), segment register(s), machine-specific register(s), instruction pointer register(s), control register(s), debug register(s), memory management register(s), machine check register(s), etc. The registers 1118 may be arranged in a bank as shown in FIG. 11. Alternatively, the registers 1118 may be organized in any other arrangement, format, or structure, such as by being distributed throughout the core 1102 to shorten access time. The second bus 1122 may be implemented by at least one of an I2C bus, a SPI bus, a PCI bus, or a PCIe bus.

Each core 1102 and/or, more generally, the microprocessor 1100 may include additional and/or alternate structures to those shown and described above. For example, one or more clock circuits, one or more power supplies, one or more power gates, one or more cache home agents (CHAs), one or more converged/common mesh stops (CMSs), one or more shifters (e.g., barrel shifter(s)) and/or other circuitry may be present. The microprocessor 1100 is a semiconductor device fabricated to include many transistors interconnected to implement the structures described above in one or more integrated circuits (ICs) contained in one or more packages.

The microprocessor 1100 may include and/or cooperate with one or more accelerators (e.g., acceleration circuitry, hardware accelerators, etc.). In some examples, accelerators are implemented by logic circuitry to perform certain tasks more quickly and/or efficiently than can be done by a general-purpose processor. Examples of accelerators include ASICs and FPGAs such as those discussed herein. A GPU, DSP and/or other programmable device can also be an accelerator. Accelerators may be on-board the microprocessor 1100, in the same chip package as the microprocessor 1100 and/or in one or more separate packages from the microprocessor 1100.

Figure 12:
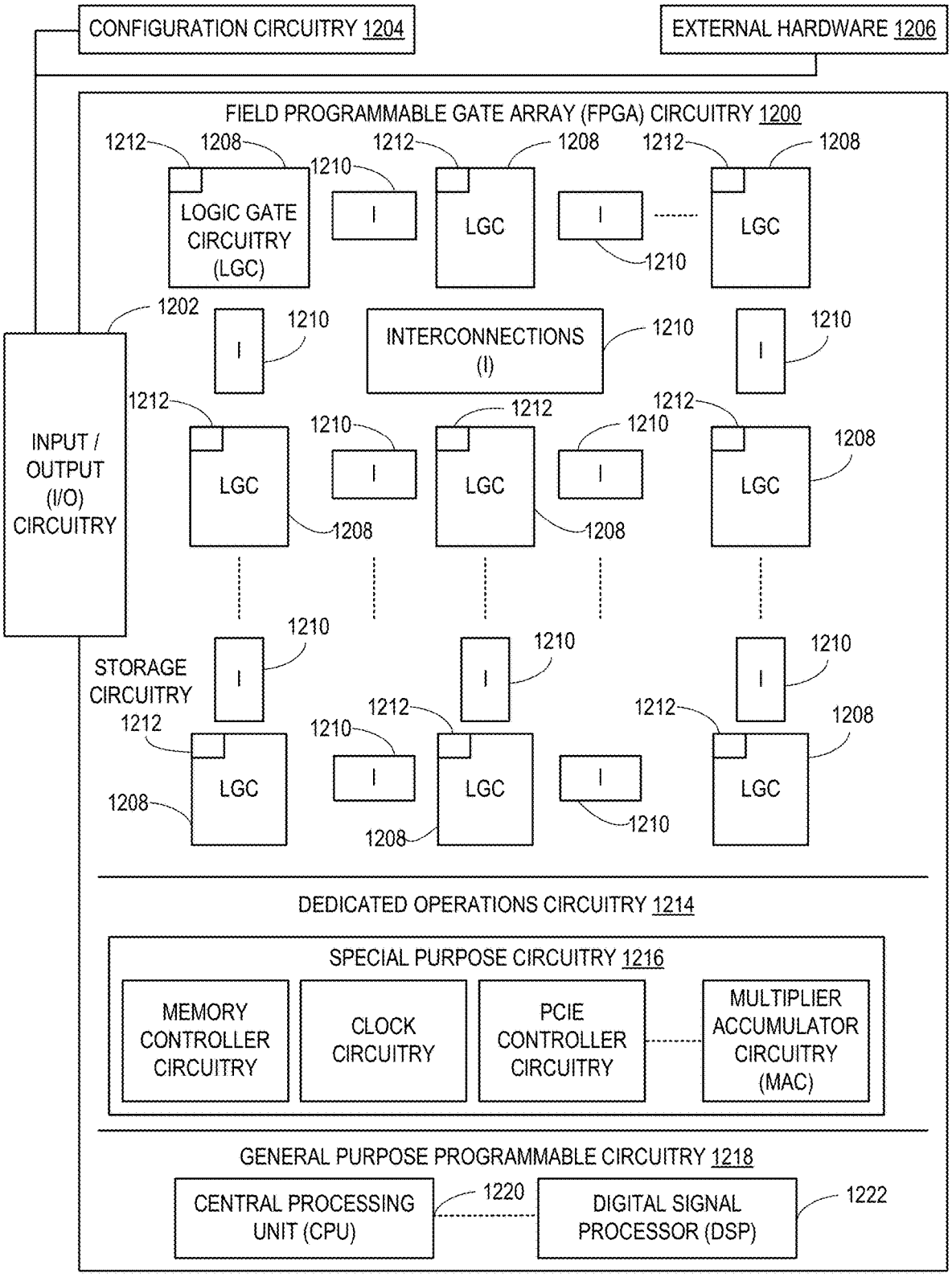
FIG. 12 is a block diagram of another example implementation of the programmable circuitry of FIG. 10.

FIG. 12 is a block diagram of another example implementation of the programmable circuitry 1012 of FIG. 10. In this example, the programmable circuitry 1012 is implemented by FPGA circuitry 1200. For example, the FPGA circuitry 1200 may be implemented by an FPGA. The FPGA circuitry 1200 can be used, for example, to perform operations that could otherwise be performed by the example microprocessor 1100 of FIG. 11 executing corresponding machine-readable instructions. However, once configured, the FPGA circuitry 1200 instantiates the operations and/or functions corresponding to the machine-readable instructions in hardware and, thus, can often execute the operations/functions faster than they could be performed by a general-purpose microprocessor executing the corresponding software.

More specifically, in contrast to the microprocessor 1100 of FIG. 11 described above (which is a general purpose device that may be programmed to execute some or all of the machine-readable instructions represented by the flowchart of FIG. 9 but whose interconnections and logic circuitry are fixed once fabricated), the FPGA circuitry 1200 of the example of FIG. 12 includes interconnections and logic circuitry that may be configured, structured, programmed, and/or interconnected in different ways after fabrication to instantiate, for example, some or all of the operations/functions corresponding to the machine-readable instructions represented by the flowchart of FIG. 9. In particular, the FPGA circuitry 1200 may be thought of as an array of logic gates, interconnections, and switches. The switches can be programmed to change how the logic gates are interconnected by the interconnections, effectively forming one or more dedicated logic circuits (unless and until the FPGA circuitry 1200 is reprogrammed). The configured logic circuits enable the logic gates to cooperate in different ways to perform different operations on data received by input circuitry. Those operations may correspond to some or all of the instructions (e.g., the software and/or firmware) represented by the flowchart of FIG. 9. As such, the FPGA circuitry 1200 may be configured and/or structured to effectively instantiate some or all of the operations/functions corresponding to the machine-readable instructions of the flowchart of FIG. 9 as dedicated logic circuits to perform the operations/functions corresponding to those software instructions in a dedicated manner analogous to an ASIC. Therefore, the FPGA circuitry 1200 may perform the operations/functions corresponding to the some or all of the machine-readable instructions of FIG. 9 faster than the general-purpose microprocessor can execute the same.

In the example of FIG. 12, the FPGA circuitry 1200 is configured and/or structured in response to being programmed (and/or reprogrammed one or more times) based on a binary file. In some examples, the binary file may be compiled and/or generated based on instructions in a hardware description language (HDL) such as Lucid, Very High Speed Integrated Circuits (VHSIC) Hardware Description Language (VHDL), or Verilog. For example, a user (e.g., a human user, a machine user, etc.) may write code or a program corresponding to one or more operations/functions in an HDL; the code/program may be translated into a low-level language as needed; and the code/program (e.g., the code/program in the low-level language) may be converted (e.g., by a compiler, a software application, etc.) into the binary file. In some examples, the FPGA circuitry 1200 of FIG. 12 may access and/or load the binary file to cause the FPGA circuitry 1200 of FIG. 12 to be configured and/or structured to perform the one or more operations/functions. For example, the binary file may be implemented by a bit stream (e.g., one or more computer-readable bits, one or more machine-readable bits, etc.), data (e.g., computer-readable data, machine-readable data, etc.), and/or machine-readable instructions accessible to the FPGA circuitry 1200 of FIG. 12 to cause configuration and/or structuring of the FPGA circuitry 1200 of FIG. 12, or portion(s) thereof.

In some examples, the binary file is compiled, generated, transformed, and/or otherwise output from a uniform software platform utilized to program FPGAs. For example, the uniform software platform may translate first instructions (e.g., code or a program) that correspond to one or more operations/functions in a high-level language (e.g., C, C++, Python, etc.) into second instructions that correspond to the one or more operations/functions in an HDL. In some such examples, the binary file is compiled, generated, and/or otherwise output from the uniform software platform based on the second instructions. In some examples, the FPGA circuitry 1200 of FIG. 12 may access and/or load the binary file to cause the FPGA circuitry 1200 of FIG. 12 to be configured and/or structured to perform the one or more operations/functions. For example, the binary file may be implemented by a bit stream (e.g., one or more computer-readable bits, one or more machine-readable bits, etc.), data (e.g., computer-readable data, machine-readable data, etc.), and/or machine-readable instructions accessible to the FPGA circuitry 1200 of FIG. 12 to cause configuration and/or structuring of the FPGA circuitry 1200 of FIG. 12, or portion(s) thereof.

The FPGA circuitry 1200 of FIG. 12, includes example input/output (I/O) circuitry 1202 to obtain and/or output data to/from example configuration circuitry 1204 and/or external hardware 1206. For example, the configuration circuitry 1204 may be implemented by interface circuitry that may obtain a binary file, which may be implemented by a bit stream, data, and/or machine-readable instructions, to configure the FPGA circuitry 1200, or portion(s) thereof. In some such examples, the configuration circuitry 1204 may obtain the binary file from a user, a machine (e.g., hardware circuitry (e.g., programmable or dedicated circuitry) that may implement an Artificial Intelligence/Machine Learning (AI/ML) model to generate the binary file), etc., and/or any combination(s) thereof). In some examples, the external hardware 1206 may be implemented by external hardware circuitry. For example, the external hardware 1206 may be implemented by the microprocessor 1100 of FIG. 11.

The FPGA circuitry 1200 also includes an array of example logic gate circuitry 1208, a plurality of example configurable interconnections 1210, and example storage circuitry 1212. The logic gate circuitry 1208 and the configurable interconnections 1210 are configurable to instantiate one or more operations/functions that may correspond to at least some of the machine-readable instructions of FIGS. 9 and/or other desired operations. The logic gate circuitry 1208 shown in FIG. 12 is fabricated in blocks or groups. Each block includes semiconductor-based electrical structures that may be configured into logic circuits. In some examples, the electrical structures include logic gates (e.g., And gates, Or gates, Nor gates, etc.) that provide basic building blocks for logic circuits. Electrically controllable switches (e.g., transistors) are present within each of the logic gate circuitry 1208 to enable configuration of the electrical structures and/or the logic gates to form circuits to perform desired operations/functions. The logic gate circuitry 1208 may include other electrical structures such as look-up tables (LUTs), registers (e.g., flip-flops or latches), multiplexers, etc.

The configurable interconnections 1210 of the illustrated example are conductive pathways, traces, vias, or the like that may include electrically controllable switches (e.g., transistors) whose state can be changed by programming (e.g., using an HDL instruction language) to activate or deactivate one or more connections between one or more of the logic gate circuitry 1208 to program desired logic circuits.

The storage circuitry 1212 of the illustrated example is structured to store result(s) of the one or more of the operations performed by corresponding logic gates. The storage circuitry 1212 may be implemented by registers or the like. In the illustrated example, the storage circuitry 1212 is distributed amongst the logic gate circuitry 1208 to facilitate access and increase execution speed.

The example FPGA circuitry 1200 of FIG. 12 also includes example dedicated operations circuitry 1214. In this example, the dedicated operations circuitry 1214 includes special purpose circuitry 1216 that may be invoked to implement commonly used functions to avoid the need to program those functions in the field. Examples of such special purpose circuitry 1216 include memory (e.g., DRAM) controller circuitry, PCIe controller circuitry, clock circuitry, transceiver circuitry, memory, and multiplier-accumulator circuitry. Other types of special purpose circuitry may be present. In some examples, the FPGA circuitry 1200 may also include example general purpose programmable circuitry 1218 such as an example CPU 1220 and/or an example DSP 1222. Other general purpose programmable circuitry 1218 may additionally or alternatively be present such as a GPU, an XPU, etc., that can be programmed to perform other operations.

Although FIGS. 11 and 12 illustrate two example implementations of the programmable circuitry 1012 of FIG. 10, many other approaches are contemplated. For example, FPGA circuitry may include an on-board CPU, such as one or more of the example CPU 1220 of FIG. 11. Therefore, the programmable circuitry 1012 of FIG. 10 may additionally be implemented by combining at least the example microprocessor 1100 of FIG. 11 and the example FPGA circuitry 1200 of FIG. 12. In some such hybrid examples, one or more cores 1102 of FIG. 11 may execute a first portion of the machine-readable instructions represented by the flowchart of FIG. 9 to perform first operation(s)/function(s), the FPGA circuitry 1200 of FIG. 12 may be configured and/or structured to perform second operation(s)/function(s) corresponding to a second portion of the machine-readable instructions represented by the flowchart of FIG. 9, and/or an ASIC may be configured and/or structured to perform third operation(s)/function(s) corresponding to a third portion of the machine-readable instructions represented by the flowchart of FIG. 9.

It should be understood that some or all of the circuitry of FIG. 2 may, thus, be instantiated at the same or different times. For example, same and/or different portion(s) of the microprocessor 1100 of FIG. 11 may be programmed to execute portion(s) of machine-readable instructions at the same and/or different times. In some examples, same and/or different portion(s) of the FPGA circuitry 1200 of FIG. 12 may be configured and/or structured to perform operations/functions corresponding to portion(s) of machine-readable instructions at the same and/or different times.

In some examples, some or all of the circuitry of FIG. 2 may be instantiated, for example, in one or more threads executing concurrently and/or in series. For example, the microprocessor 1100 of FIG. 11 may execute machine-readable instructions in one or more threads executing concurrently and/or in series. In some examples, the FPGA circuitry 1200 of FIG. 12 may be configured and/or structured to carry out operations/functions concurrently and/or in series. Moreover, in some examples, some or all of the circuitry of FIG. 2 may be implemented within one or more virtual machines and/or containers executing on the microprocessor 1100 of FIG. 11.

In some examples, the programmable circuitry 1012 of FIG. 10 may be in one or more packages. For example, the microprocessor 1100 of FIG. 11 and/or the FPGA circuitry 1200 of FIG. 12 may be in one or more packages. In some examples, an XPU may be implemented by the programmable circuitry 1012 of FIG. 10, which may be in one or more packages. For example, the XPU may include a CPU (e.g., the microprocessor 1100 of FIG. 11, the CPU 1220 of FIG. 12, etc.) in one package, a DSP (e.g., the DSP 1222 of FIG. 12) in another package, a GPU in yet another package, and an FPGA (e.g., the FPGA circuitry 1200 of FIG. 12) in still yet another package.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc., may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, or (7) A with B and with C. As used herein in the context of describing structures, components, items, objects and/or things, the phrase "at least one of A and B" is intended to refer to implementations including any of (1) at least one A, (2) at least one B, or (3) at least one A and at least one B. Similarly, as used herein in the context of describing structures, components, items, objects and/or things, the phrase "at least one of A or B" is intended to refer to implementations including any of (1) at least one A, (2) at least one B, or (3) at least one A and at least one B. As used herein in the context of describing the performance or execution of processes, instructions, actions, activities, etc., the phrase "at least one of A and B" is intended to refer to implementations including any of (1) at least one A, (2) at least one B, or (3) at least one A and at least one B. Similarly, as used herein in the context of describing the performance or execution of processes, instructions, actions, activities, etc., the phrase "at least one of A or B" is intended to refer to implementations including any of (1) at least one A, (2) at least one B, or (3) at least one A and at least one B.

As used herein, singular references (e.g., "a", "an", "first", "second", etc.) do not exclude a plurality. The term "a" or "an" object, as used herein, refers to one or more of that object. The terms "a" (or "an"), "one or more", and "at least one" are used interchangeably herein. Furthermore, although individually listed, a plurality of means, elements, or actions may be implemented by, e.g., the same entity or object. Additionally, although individual features may be included in different examples or claims, these may possibly be combined, and the inclusion in different examples or claims does not imply that a combination of features is not feasible and/or advantageous.

As used herein, unless otherwise stated, the term "above" describes the relationship of two parts relative to Earth. A first part is above a second part, if the second part has at least one part between Earth and the first part. Likewise, as used herein, a first part is "below" a second part when the first part is closer to the Earth than the second part. As noted above, a first part can be above or below a second part with one or more of: other parts therebetween, without other parts therebetween, with the first and second parts touching, or without the first and second parts being in direct contact with one another.

Unless specifically stated otherwise, descriptors such as "first," "second," "third," etc., are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly within the context of the discussion (e.g., within a claim) in which the elements might, for example, otherwise share a same name.

As used herein, "approximately" and "about" modify their subjects/values to recognize the potential presence of variations that occur in real world applications. For example, "approximately" and "about" may modify dimensions that may not be exact due to manufacturing tolerances and/or other real world imperfections as will be understood by persons of ordinary skill in the art. For example, "approximately" and "about" may indicate such dimensions may be within a tolerance range of +/−10% unless otherwise specified herein.

As used herein "substantially real time" refers to occurrence in a near instantaneous manner recognizing there may be real world delays for computing time, transmission, etc. Thus, unless otherwise specified, "substantially real time" refers to real time+1 second.

As used herein, the phrase "in communication," including variations thereof, encompasses direct communication and/or indirect communication through one or more intermediary components, and does not require direct physical (e.g., wired) communication and/or constant communication, but rather additionally includes selective communication at periodic intervals, scheduled intervals, aperiodic intervals, and/or one-time events.

As used herein, "programmable circuitry" is defined to include (i) one or more special purpose electrical circuits (e.g., an application specific circuit (ASIC)) structured to perform specific operation(s) and including one or more semiconductor-based logic devices (e.g., electrical hardware implemented by one or more transistors), and/or (ii) one or more general purpose semiconductor-based electrical circuits programmable with instructions to perform specific functions(s) and/or operation(s) and including one or more semiconductor-based logic devices (e.g., electrical hardware implemented by one or more transistors). Examples of programmable circuitry include programmable microprocessors such as Central Processor Units (CPUs) that may execute first instructions to perform one or more operations and/or functions, Field Programmable Gate Arrays (FPGAs) that may be programmed with second instructions to cause configuration and/or structuring of the FPGAs to instantiate one or more operations and/or functions corresponding to the first instructions, Graphics Processor Units (GPUs) that may execute first instructions to perform one or more operations and/or functions, Digital Signal Processors (DSPs) that may execute first instructions to perform one or more operations and/or functions, XPUs, Network Processing Units (NPUs) one or more microcontrollers that may execute first instructions to perform one or more operations and/or functions and/or integrated circuits such as Application Specific Integrated Circuits (ASICs). For example, an XPU may be implemented by a heterogeneous computing system including multiple types of programmable circuitry (e.g., one or more FPGAs, one or more CPUs, one or more GPUs, one or more NPUs, one or more DSPs, etc., and/or any combination(s) thereof), and orchestration technology (e.g., application programming interface(s) (API(s)) that may assign computing task(s) to whichever one(s) of the multiple types of programmable circuitry is/are suited and available to perform the computing task(s).

As used herein, integrated circuit/circuitry is defined as one or more semiconductor packages containing one or more circuit elements such as transistors, capacitors, inductors, resistors, current paths, diodes, etc. For example an integrated circuit may be implemented as one or more of an ASIC, an FPGA, a chip, a microchip, programmable circuitry, a semiconductor substrate coupling multiple circuit elements, a system on chip (SoC), etc.

From the foregoing, it will be appreciated that example systems, apparatus, articles of manufacture, and methods have been disclosed that display useful pose information and can provide effective recommendations for operation of a first watercraft relative to a second watercraft. Disclosed systems, apparatus, articles of manufacture, and methods improve the efficiency of using a computing device by providing a recommendation for operation of the first watercraft without necessitating a need for extraneous computational equipment, which can have significant computational overhead/needs. Disclosed systems, apparatus, articles of manufacture, and methods are accordingly directed to one or more improvement(s) in the operation of a machine such as a computer or other electronic and/or mechanical device. Further examples and combinations thereof include the following:

Example 1 includes an apparatus comprising interface circuitry communicatively coupled to a sensor carried by a first watercraft, machine-readable instructions, and programmable circuitry to at least one of instantiate or execute the machine-readable instructions to calculate a pose between the first watercraft and a second watercraft based on output from the sensor, determine whether the first watercraft is within a threshold offset relative to the second watercraft based on the pose, and provide an indication as to whether or not to adjust operation of the first watercraft based on whether or not the first watercraft is within the threshold offset relative to the second watercraft.

Example 2 includes the apparatus of example 1, wherein the threshold offset corresponds to a first speed of the first watercraft and a second speed of the second watercraft.

Example 3 includes the apparatus of example 1, wherein the indication as to whether or not to adjust operation of the first watercraft includes a current trajectory of the first watercraft and a desired trajectory to guide the first watercraft with respect to the threshold offset.

Example 4 includes the apparatus of example 1, wherein the indication as to whether or not to adjust operation is displayed on at least one of a mobile device, a watercraft navigation panel, or a desktop computer onboard the first watercraft.

Example 5 includes the apparatus of example 1, wherein the programmable circuitry is to cause a display to display at least one of (i) a distance between the first watercraft and the second watercraft, or (ii) a first speed of the first watercraft and a second speed of the second watercraft.

Example 6 includes the apparatus of example 1, wherein the programmable circuitry is to cause a display to display a region around the first watercraft, the region indicating an area in which the first watercraft may traverse during a recommended vehicle operation.

Example 7 includes the apparatus of example 1, wherein the second watercraft includes at least one marker to be tracked by the sensor carried by the first watercraft.

Example 8 includes the apparatus of example 1, wherein the indication to adjust operation of the first watercraft includes a recommended heading and a recommended speed of the first watercraft.

Example 9 includes the apparatus of example 1, wherein the pose corresponds to a relative heading and a relative position between the first watercraft and the second watercraft.

Example 10 includes a non-transitory computer-readable medium comprising instructions to cause processor circuitry to at least calculate a pose between a first watercraft and a second watercraft based on output from a sensor carried by the first watercraft, determine whether the first watercraft is within a threshold offset relative to the second watercraft based on the pose, and provide an indication as to whether or not to adjust operation of the first watercraft based on whether or not the first watercraft is within the threshold offset relative to the second watercraft.

Example 11 includes the non-transitory computer-readable medium of example 10, wherein the threshold offset corresponds to a first speed of the first watercraft and a second speed of the second watercraft.

Example 12 includes the non-transitory computer-readable medium of example 10, wherein the indication as to whether or not to adjust operation includes a current trajectory of the first watercraft and a desired trajectory to guide the first watercraft with respect to the threshold offset.

Example 13 includes the non-transitory computer-readable medium of example 10, wherein the instructions cause the processor circuitry to display at least one of (i) a distance between the first watercraft and the second watercraft, or (ii) a first speed of the first watercraft and a second speed of the second watercraft.

Example 14 includes the non-transitory computer-readable medium of example 10, wherein the instructions cause the processor circuitry to display a region around the first watercraft, the region indicating an area in which the first watercraft may traverse during a recommended vehicle operation.

Example 15 includes the non-transitory computer-readable medium of example 10, wherein the indication as to whether or not to adjust for operation of the first watercraft includes a recommended heading and a recommended speed of the first watercraft.

Example 16 includes the non-transitory computer-readable medium of example 10, wherein the pose corresponds to a relative heading and a relative position between the first watercraft and the second watercraft.

Example 17 includes a method comprising calculating a pose between a first watercraft and a second watercraft based on output from a sensor carried by the first watercraft, determining whether the first watercraft is within a threshold offset relative to the second watercraft based on the pose, and providing an indication as to whether or not to adjust operation of the first watercraft based on whether or not the first watercraft is within the threshold offset relative to the second watercraft.

Example 18 includes the method of example 17, further including displaying at least one of (i) a distance between the first watercraft and the second watercraft, or (ii) a first speed of the first watercraft and a second speed of the second watercraft.

Example 19 includes the method of example 17, further including displaying a region around the first watercraft, the region indicating an area in which the first watercraft may traverse during a recommended vehicle operation.

Example 20 includes the method of example 17, wherein the indication as to whether or not to adjust operation of the first watercraft includes a recommended heading and a recommended speed of the first watercraft.

The following claims are hereby incorporated into this Detailed Description by this reference. Although certain example systems, apparatus, articles of manufacture, and methods have been disclosed herein, the scope of coverage of this patent is not limited thereto. On the contrary, this patent covers all systems, apparatus, articles of manufacture, and methods fairly falling within the scope of the claims of this patent.

What is claimed is:

1. An apparatus to guide a watercraft comprising:

interface circuitry communicatively coupled to at least one sensor of a mobile device carried by a first watercraft;

machine-readable instructions; and programmable circuitry to at least one of instantiate or execute the machine-readable instructions to:

calculate a relative position of the mobile device to a marker of a second watercraft based on an output of the at least one sensor corresponding to detection of the marker, the marker communicatively coupled to the mobile device;

calculate a pose between the first watercraft and the second watercraft based on the relative position;

determine whether the first watercraft is within a threshold offset relative to the second watercraft based on the pose; and provide an indication as to whether to adjust operation of the first watercraft based on whether the first watercraft is within the threshold offset relative to the second watercraft.

2. The apparatus of claim 1, wherein the threshold offset corresponds to a first speed of the first watercraft and a second speed of the second watercraft.

3. The apparatus of claim 1, wherein the indication as to whether to adjust the operation of the first watercraft includes a current trajectory of the first watercraft and a desired trajectory to guide the first watercraft with respect to the threshold offset.

4. The apparatus of claim 1, wherein the indication as to whether to adjust the operation of the first watercraft is displayed on at least one of the mobile device, a watercraft navigation panel, or a desktop computer onboard the first watercraft.

5. The apparatus of claim 1, wherein the programmable circuitry is to cause a display to display at least one of (i) a distance between the first watercraft and the second watercraft, or (ii) a first speed of the first watercraft and a second speed of the second watercraft.

6. The apparatus of claim 1, wherein the programmable circuitry is to cause a display to display a region around the first watercraft, the region indicating an area in which the first watercraft may traverse during a recommended vehicle operation.

7. The apparatus of claim 1, wherein the second watercraft includes at least one marker to be tracked by the sensor carried by the first watercraft.

8. The apparatus of claim 1, wherein the indication to adjust the operation of the first watercraft includes a recommended heading and a recommended speed of the first watercraft.

9. The apparatus of claim 1, wherein the pose further includes a relative heading between the first watercraft and the second watercraft.

10. A non-transitory computer-readable medium comprising instructions to cause processor circuitry to at least:

calculate a relative position of at least one sensor of a mobile device carried by a first watercraft to a marker of a second watercraft based on an output of the at least one sensor corresponding to detection the marker, the marker communicatively coupled to the mobile device;

calculate a pose between the first watercraft and the second watercraft based on the relative position;

determine whether the first watercraft is within a threshold offset relative to the second watercraft based on the pose; and provide an indication as to whether to adjust operation of the first watercraft based on whether the first watercraft is within the threshold offset relative to the second watercraft.

11. The non-transitory computer-readable medium of claim 10, wherein the threshold offset corresponds to a first speed of the first watercraft and a second speed of the second watercraft.

12. The non-transitory computer-readable medium of claim 10, wherein the indication as to whether to adjust the operation of the first watercraft includes a current trajectory of the first watercraft and a desired trajectory to guide the first watercraft with respect to the threshold offset.

13. The non-transitory computer-readable medium of claim 10, wherein the instructions cause the processor circuitry to display at least one of (i) a distance between the first watercraft and the second watercraft, or (ii) a first speed of the first watercraft and a second speed of the second watercraft.

14. The non-transitory computer-readable medium of claim 10, wherein the instructions cause the processor circuitry to display a region around the first watercraft, the region indicating an area in which the first watercraft may traverse during a recommended vehicle operation.

15. The non-transitory computer-readable medium of claim 10, wherein the indication as to whether to adjust the operation of the first watercraft includes a recommended heading and a recommended speed of the first watercraft.

16. The non-transitory computer-readable medium of claim 10, wherein the pose further includes a relative heading between the first watercraft and the second watercraft.

17. A method comprising:

calculating a relative position of at least one sensor of a mobile device carried by a first watercraft to a marker of a second watercraft based on an output of the at least one sensor corresponding to detection of the marker, the marker communicatively coupled to the mobile device;

calculating a pose between the first watercraft and the second watercraft based on the relative position;

determining whether the first watercraft is within a threshold offset relative to the second watercraft based on the pose; and providing an indication as to whether to adjust operation of the first watercraft based on whether or not the first watercraft is within the threshold offset relative to the second watercraft.

18. The method of claim 17, further including displaying at least one of (i) a distance between the first watercraft and the second watercraft, or (ii) a first speed of the first watercraft and a second speed of the second watercraft.

19. The method of claim 17, further including displaying a region around the first watercraft, the region indicating an area in which the first watercraft may traverse during a recommended vehicle operation.

20. The method of claim 17, wherein the indication as to whether to adjust the operation of the first watercraft includes a recommended heading and a recommended speed of the first watercraft.

* * * * *